US007929889B2

(12) United States Patent
Yamada et al.

(10) Patent No.: US 7,929,889 B2
(45) Date of Patent: Apr. 19, 2011

(54) IMAGE FORMING APPARATUS AND IMAGE FORMING METHOD

(75) Inventors: Yoichi Yamada, Shiojiri (JP); Atsunori Kitazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 12/621,743

(22) Filed: Nov. 19, 2009

(65) Prior Publication Data

US 2010/0143006 A1 Jun. 10, 2010

(30) Foreign Application Priority Data

Dec. 10, 2008 (JP) ..... 2008-314167

(51) Int. Cl.
*G03G 15/08* (2006.01)

(52) U.S. Cl. ..... 399/279; 399/50; 399/55; 399/71

(58) Field of Classification Search ..... 399/46, 399/50, 55, 66, 71, 149, 150, 252, 279
See application file for complete search history.

(56) References Cited

U.S. PATENT DOCUMENTS 6,128,449 A * 10/2000 Zenba et al. ..... 399/50
7,239,831 B2 * 7/2007 Hagiwara et al. ..... 399/270

FOREIGN PATENT DOCUMENTS

| | | |
|---|---|---|
| JP | 2001-343779 | 12/2001 |
| JP | 2005-189410 | 7/2005 |
| JP | 2006-011137 | 1/2006 |
| JP | 2006-091566 | 4/2006 |
| JP | 2007-140080 | 6/2007 |
| JP | 2007-316135 | 12/2007 |

* cited by examiner

*Primary Examiner* — Hoang Ngo
(74) *Attorney, Agent, or Firm* — Workman Nydegger

(57) ABSTRACT

Provided is an image forming apparatus including: a latent image carrier; a charging unit; a latent image forming unit; a developing unit that has a toner carrier; a transferring unit that transfers the toner image on the transfer medium; and a cleaning unit that removes a toner that remains to be adhered to the latent image carrier, wherein the toner carrier carries a toner layer including a contact toner that is directly in contact with the surface of the toner carrier and a non-contact toner that is not directly in contact with the surface of the toner carrier on the surface thereof, and wherein a voltage of the transferring bias is a DC voltage that does not generate discharge between the image portion of the latent image carrier and the transfer medium but generate discharge between the non-image portion of the latent image carrier and the transfer medium.

12 Claims, 12 Drawing Sheets

● POSITIVELY CHARGED (REVERSE POLARITY) PARTICLE
○ NEGATIVELY CHARGED (REGULAR POLARITY) PARTICLE

EXPOSED PORTION

NON-EXPOSED PORTION

POSITIVELY CHARGED (REVERSE POLARITY) PARTICLE

NEGATIVELY CHARGED (REGULAR POLARITY) PARTICLE

IMAGE FORMING APPARATUS AND IMAGE FORMING METHOD

BACKGROUND

1. Technical Field

The present invention relates to an image forming apparatus and an image forming method of forming an image by developing an electrostatic latent image formed on a latent image carrier with a charged toner carried in a toner carrier.

2. Related Art

In an image forming apparatus and an image forming method where an electrostatic latent image on a latent image carrier is developed as a toner image and the toner image is transferred to a transfer medium, since a transfer efficiency from the latent image carrier to the transfer medium is 100% or less, a small amount of toner may remain on a surface of the after-transferring latent image carrier. In addition, generally, a toner (so-called fogging toner) adhered to a non-image portion of the electrostatic latent image, to which any toner is not originally to be adhered, is also not transferred but remains. In relation to such a remaining toner, in a general image forming apparatus, a cleaning member is designed to abut the surface of the after-transferred latent image carrier (refer to JP-A-2006-091566). In addition, as another example, JP-A-2007-316135 discloses a technology where charges are suitably applied to the remaining toner on the latent image carrier and the remaining toner is electrostatically recovered into a developer by a developing roller that abuts the latent image carrier.

Such a remaining toner occurs when an image forming process is performed. Therefore, in the configuration of removing the remaining toner, a consumed amount of a wasteful toner that does not contribute to the image forming is increased. In addition, in the configuration of recovering the remaining toner into the developer, such waste of toner does not occur. However, a used, deteriorated toner is increased in the developer; thus, the image quality is gradually reduced.

In addition, recently, in order to implement a highly accurate image, a high speed process, and a low fixing temperature, it has been considered to employ a toner having a smaller diameter than that of a currently-provided toner. In the toner having such a small diameter, due to an increase in a mirror image force or a van de Walls force, an adhesive force of the toner to the latent image carrier is larger than that of the toner having a large diameter. Therefore, it is difficult to remove the remaining toner from the latent image carrier. Particularly, in an AC jumping developing scheme where the latent image carrier and the toner carrier are disposed to non-contactively face each other and the development is performed by flying the toner by using an alternating electric field, during the reciprocating movement of the micro-diameter toner, the toner is trapped in the latent image carrier by the aforementioned force, and thus, the toner having a charged polarity that is originally not to be adhered is adhered to the latent image carrier. Therefore, the problems of the occurrence of ground fogging and the increase in the toner consumption caused by the fogging become very serious.

SUMMARY

An advantage of some aspects of the invention is to provide a technology capable of suppressing wasteful toner consumption and coping with implementation of a micro-diameter toner for an image forming apparatus and method where an electrostatic latent image formed on a latent image carrier is developed with a charged toner carried in a toner carrier.

According to an aspect of the invention, there is provided an image forming apparatus comprising: a latent image carrier that circulates in a predetermined rotating direction; a charging unit that charges a surface of the latent image carrier with a voltage having the same polarity as a regular charging polarity of a toner non-contactively to the surface of the latent image carrier at a predetermined charging position; a latent image forming unit that forms an electrostatic latent image on the surface of the latent image carrier by allowing the voltages of the charged surface of the latent image carrier to be different from each other between an image portion to which the toner is adhered and a non-image portion to which the toner is not adhered at a latent image forming position in a downstream of the charging position in the rotating direction; a developing unit that has a toner carrier non-contactively facing the latent image carrier at a developing position in a downstream of the latent image forming position in the rotating direction and develops the electrostatic latent image as a toner image by transporting a charged toner carried on a surface of the toner carrier to the developing position and applying an alternating voltage as a developing bias; a transferring unit that transfers the toner image on the transfer medium by abutting a transfer medium on the latent image carrier and applying a transferring bias having a polarity opposite to the regular charging polarity to the transfer medium at a transferring position in the downstream of the developing position in the rotating direction; and a cleaning unit that removes a toner that is charged with a regular charging polarity and remains to be adhered to the surface of the latent image carrier by abutting an abutting member applied with a voltage having a polarity opposite to the regular charging polarity on the latent image carrier at a cleaning position in a downstream of the transferring position in the rotating direction, wherein the toner carrier carries a toner layer including a contact toner that is directly in contact with the surface of the toner carrier and a non-contact toner that is not directly in contact with the surface of the toner carrier on the surface thereof, and wherein a voltage of the transferring bias is a DC voltage that does not generate discharge between the image portion of the latent image carrier and the transfer medium but generate discharge between the non-image portion of the latent image carrier and the transfer medium.

The image forming apparatus having such a configuration is a so-called AC jumping developing type image forming apparatus where the latent image carrier carrying the electrostatic latent image and the toner carrier are disposed to non-contactively face each other and an alternating electric field is generated therebetween to develop the electrostatic latent image with the toner. In the image forming apparatus having such a configuration according to the invention, a toner layer including a contact toner that is directly in contact with the toner carrier and a non-contact toner that is not directly in contact with the toner carrier is carried in the toner carrier. Herein, the non-contact toner is in contact with the contact toner that is in contact with the surface of the toner carrier, so that the non-contact toner is indirectly carried in the toner carrier. The non-contact toner is originated from toner particles of which charged amount is small and of which adhesive force to the toner carrier is relatively weak. The contact toner is bound by the strong adhesive force that the latent image carrier exerts thereto, so that the contact toner cannot easily fly from the surface of the toner carrier. On the other hand, the non-contact toner is bound by a weaker binding force, so that the non-contact toner can easily fly. However, since the non-contact toner has a small charged amount, the non-contact toner can easily become a fogging toner.

The charged toner carried in the toner carrier inevitably includes a toner (hereinafter, simply referred to as a "regularly charged toner") charged with a regularly charged polarity that is the expected original charged polarity of the toner, and a toner (hereinafter, referred to as a "weakly charged toner") having a very small charged amount, and a toner (hereinafter, simply referred to as a "reversely charged toner") having a polarity opposite to the regularly charged polarity. At the developing position, the developing bias or the like is set so that the toner is adhered only to the image portion of the surface of the latent image carrier. However, such a weakly charged toner or a reversely charged toner can be adhered to the non-image portion.

In an image forming apparatus in the related art, a cleaning unit is provided, in order to remove the toner adhered to the non-image portion. However, in the invention, the regularly charged toner is removed from the latent image carrier, and the operation is performed in the state where some amount of the reversely charged toner remains adhered to the latent image carrier. In order to implement selective adhesion of the toner according to the charged polarity, the invention is contrived to have the following configuration.

More specifically, at the transferring position, a transferring bias having a polarity opposite to the regularly charged polarity of the toner is applied to a transfer medium, and the magnitude of the voltage thereof is set so that discharge is not generated between the transfer medium and the image portion of the latent image carrier but the discharge is generated between the transfer medium and the non-image portion. Therefore, just before the transferring position, charges having a polarity opposite to the regularly charged polarity of the toner are injected into the toner adhered to the non-image portion of the latent image carrier. Accordingly, the charged polarity of the regularly charged toner adhered to the non-image portion of the latent image carrier can be inverted, and the charged amount of the reversely charged toner can be increased. In addition, just before the transferring position, there is no discharge between the image portion of the latent image carrier and the transfer medium, so that the toner adhered to the image portion of the latent image carrier can be moved to the transferring position without a change in the charged polarity thereof. In addition, since the transfer medium is applied with a voltage having a polarity opposite to the regularly charged polarity, at the transferring position, the reversely charged toner of the non-image portion is not transferred but remains in the latent image carrier, and the regularly charged toner of the image portion is transferred to the transfer medium.

In addition, at the cleaning position, the abutting member applied with the cleaning bias having a polarity opposite to the regularly charged polarity is allowed to abut the latent image carrier. Therefore, in this case, the regularly charged toner is adsorbed to the abutting member, so that the toner is removed from the latent image carrier or the polarity thereof is inverted. On the other hand, the charged amount of the reversely charged toner is increased. In addition, since the abutting member is applied with the voltage having a polarity opposite to the regularly charged polarity, the reversely charged toner is not adsorbed to the abutting member but remains in the latent image carrier.

In addition, in the invention, since the charging unit is non-contactively disposed with respect to the latent image carrier, the remaining toner of the latent image carrier returns to the developing position without being moved into the charging unit. At this time, the reversely charged toner is already adhered to the surface of the latent image carrier, and the charged amount of the toner can be increased. Since the adhesive force that the latent image carrier exerts to the toner is weak in comparison with a toner newly flying and having a smaller charged amount, adhesion of a newly reversely charged toner cannot easily occur. In addition, since the adhesive force to the regularly charged toner can be weakened by the reversely charged toner that already exists on the latent image carrier, the regularly charged toner can securely return to the toner carrier by the electric field in the direction of pulling the regularly charged toner back to the toner carrier, so that the adhesion of a new fogging toner can be suppressed. In addition, the toner charged with a reverse polarity on the latent image carrier cannot return to the toner carrier even by the electric field in the direction of pulling the toner back to the toner carrier. In addition, since the charged amount of the toner can be increased, the adhesive force to the latent image carrier is strong, and the recovery to the toner carrier can be suppressed.

As a result, in the invention, the operation is performed in the state where an almost constant amount of the reversely charged toner is adhered to the surface of the latent image carrier. In other words, according to the contrived configuration of the invention, the latent image carrier can be circulated in the state where a constant amount of the reversely charged toner is adhered to the surface of the latent image carrier. Herein, in the case where the remaining toner is configured to be removed during the circulation of the latent image carrier, the process of supplying a newly reversely charged toner to the non-image portion of the latent image carrier at the developing position according to the aforementioned principle so as to remove the remaining toner is repeated, so that wasteful toner consumption is increased. However, in the invention, the amount of the reversely charged toner adhered to the non-image portion of the latent image carrier is not gradually increased, and there is no toner to be removed, so that wasteful toner consumption can be suppressed.

Although the toner adhered to the non-image portion of the latent image carrier may cause the ground fogging, in the invention, the polarity of the toner adhered to the non-image portion of the latent image carrier is inverted to the reverse polarity at the transferring position, and the regularly charged toner remaining on the latent image carrier is removed by the cleaning unit, so that the reversely charged toner can selectively remain on the latent image carrier. In addition, since the transfer medium is applied with a transferring bias having a polarity opposite to the regularly charged polarity, that is, the same polarity as the reversely charged toner, the reversely charged toner on the latent image carrier cannot be transferred to the transfer medium. Accordingly, the ground fogging cannot occur.

In addition, all the after-transferred remaining toners are not necessarily removed but the toner is configured to actively remain on the latent image carrier while controlling the charged polarity thereof. Therefore, the invention can very suitably be adapted even in the case of using the micro-diameter toner, of which adhesive force is too strong for the toner to be completely removed.

According to another aspect of the invention, there is provided an image forming method comprising: disposing, around a latent image carrier that circulates in a predetermined rotating direction, a charging unit that charges a surface of the latent image carrier with a voltage having the same polarity as a regular charging polarity of a toner non-contactively to the surface of the latent image carrier, a latent image forming unit that forms an electrostatic latent image on the surface of the latent image carrier by allowing the voltages of the surface of the latent image carrier charged by the charging unit to be different from each other between an image portion to which the toner is adhered and a non-image portion to which the toner is not adhered, a developing unit that has a toner carrier non-contactively facing the latent image carrier and develops the electrostatic latent image as a toner image by carrying a charged toner on a surface of the toner carrier and applying an alternating voltage as a developing bias, a transferring unit that transfers the toner image on the transfer medium by abutting a transfer medium on the latent image carrier and applying a transferring bias having a polarity opposite to the regular charging polarity to the transfer medium, and a cleaning unit that removes a toner that is charged with a regular charging polarity and remains to be adhered to the surface of the latent image carrier by abutting an abutting member applied with a voltage having a polarity opposite to the regular charging polarity on the latent image carrier, along the rotating direction in this order, wherein the toner carrier is allowed to carry a toner layer including a contact toner that is directly in contact with the surface of the toner carrier and a non-contact toner that is not directly in contact with the surface of the toner carrier on the surface thereof, and wherein a voltage of the transferring bias is a DC voltage that does not generate discharge between the image portion of the latent image carrier and the transfer medium but generate discharge between the non-image portion of the latent image carrier and the transfer medium.

Similarly to the aforementioned invention of the image forming apparatus, in the invention having such a configuration, it is possible to suppress wasteful toner consumption and to cope with a micro-diameter toner.

In the invention, the toner carrier may be a toner carrying roller that is formed in a roller shape having regular concave and convex portions on a surface thereof to be rotated, and the non-contact toner may be carried in a concave portion of the surface of the toner carrying roller. Accordingly, since the non-contact toner is carried in the concave portions that are recessed from the surface of the toner carrying roller, the flying of the toner from the latent image carrier caused from the weak adhesive force can be prevented.

In addition, the toner carrier may be a toner carrying roller that is formed in a roller shape having regular concave and convex portions on a surface thereof to be rotated, a top surface of each convex portion may become a portion of the same cylindrical surface, a difference in height of the convex portion from a concave portion may be twice as large as a volume average diameter of the toner, and the developing unit may have a regulating member that is constructed with an elastic material to regulate toner adhesion to the convex portion by abutting an edge portion of the regulating member on the convex portion of the toner carrying roller at an upstream side of the developing position in the rotating direction of the toner carrying roller.

According to such a configuration, the toner adhered in the convex portions among the toner supplied to the surface of the toner carrying roller is scraped by the regulating member, so that the toner is carried in the concave portions. At this time, since a difference in height between the convex portion and the concave portion is at least twice the volume average diameter of the toner, two or more layers of the toners having an average diameter can be carried in the concave portions. Therefore, the contact toner contacting with the toner carrying roller and the non-contact toner not contacting with the toner carrying roller are carried in the concave portions. In addition, since the non-contact toner is carried in the concave portions, the non-contact toner cannot easily fly. In such a simple configuration, similarly to the aforementioned case, the flying of the non-contact toner is also prevented. In addition, the carrying of the toner in the convex portion is regulated, so that the toner is carried in the concave portions. Therefore, the amount of the transported toner is stabilized. In addition, since the toner in the concave portions is not rubbingly abraded to the regulating member, the characteristics do not deteriorate. Accordingly, there is an excellent effect in that a good image quality can be obtained.

In the structure, a toner layer having good quality and low determination can be carried on the toner carrying roller. The phrase "toner layer having good quality" denotes that the charged amount of the toner is well arranged on the toner carrying roller and a variation thereof is small. Accordingly, the containing ratio of the reversely charged toner may become low. However, in the invention, a technology of allowing the reversely charged toner to remain on the latent image carrier though the generation of the reversely charged toner by a bias applied to the transfer medium or the abutting member is implemented.

In addition, in a case where an electric field strength in the surface of the toner carrier required for the non-contact toner to fly from the surface of the toner carrier is a non-contact toner flying start electric field strength and an electric field strength in the surface of the toner carrier required for the contact toner to fly from the surface of the toner carrier is a contact toner flying start electric field strength, a maximum value of a strength of an electric field generated between the image portion of the latent image carrier and the toner carrier by the developing bias may be larger than the contact toner flying start electric field strength, and a maximum value of a strength of an electric field generated between the non-image portion of the latent image carrier and the toner carrier by the developing bias may be larger than the non-contact toner flying start electric field strength.

As described above, the binding force of the contact toner to the toner carrier is large, but the binding force of the non-contact toner is small. Therefore, the contact toner flying start electric field strength is necessarily larger than the non-contact toner flying start electric field strength. The strength of the electric field generated between the toner carrier and the image portion of the latent image carrier is designed to be higher than the contact toner flying start electric field strength, so that the contact toner is flying between the toner carrier and the image portion of the latent image carrier at the developing position. Reasonably, the non-contact toner having a weaker binding force is also flying. On the other hand, since the electric field strength between the toner carrier and the non-image portion of the latent image carrier is smaller than the contact toner flying start electric field strength but larger than the non-contact toner flying start electric field strength, the non-contact toner is mainly flying. The non-contact toner includes a large amount of the toner having a small charged amount. Therefore, in such a configuration, the toner having a small charged amount is selectively adhered to the non-image portion of the latent image carrier, and the toner remains on the latent image carrier while controlling the charged polarity thereof. Therefore, the adhesive force to the latent image carrier is reduced, so that the toner consumption caused from the fogging can be suppressed.

Accordingly, since the regularly charged toner having a large charged amount is not moved to the non-image portion of the latent image carrier, the regularly charged toner having a large charged amount adhered to the non-image portion is transferred to the transfer medium without polarity inversion at the transferring position, and the ground fogging cannot occur.

In addition, in a case where an electric field strength in the surface of the toner carrier required for the contact toner to fly from the surface of the toner carrier is a contact toner flying start electric field strength, a voltage of the image portion of the latent image carrier at the developing position is VL, a voltage of the non-image portion is Vo, a voltage of the developing bias at the time when a force generated to bias the toner charged with the regular charging polarity in a direction from the toner carrier to the latent image carrier is in maximum is Vmin, an adhesive force of the contact toner to the toner carrier is Fc, and an adhesive force of the non-contact toner to the toner carrier is Fn, a maximum value of a strength of an electric field generated between the image portion of the latent image carrier and the toner carrier by the developing bias is larger than the contact toner flying start electric field strength, and the following equation is satisfied.

$$|V\min-VL|/|V\min-Vo|<Fc/Fn$$

As described later in detail, the inequality denotes the condition that the non-contact toner charged with the regular polarity is to be adhered to the non-image portion of the latent image carrier. In other words, if the operating condition is set so that the aforementioned relationship is satisfied, the non-contact toner charged with the regular polarity can be adhered to the non-image portion of the latent image carrier after the developing position. At the transferring position and the cleaning position, the charged polarity of the non-contact toner having a small charged amount can easily be inverted to the reverse polarity. As a result, the operation can be implemented in the state where the reversely charged toner is adhered to the latent image carrier.

In this case, particularly, a relationship of the following equation may be satisfied.

$$|V\min-VL|/|V\min-Vo|<7$$

As described later in detail, assuming that the arrangement of the toner particles on the toner carrier is a hexagonal close-packed arrangement where the particles are the closest thereto so that the adhesive force is maximized (that is, the condition that the flying of the non-contact toner is the most difficult), the ratio (Fc/Fn) of the adhesive force of contact toner to the adhesive force of the non-contact toner becomes about 7. Therefore, if the voltages are set so that the left-handed side of the above equation is smaller than 7, the non-contact toner can securely be adhered to the non-image portion of the latent image carrier.

In addition, a voltage of the non-image portion of the latent image carrier at the developing position is Vo, a voltage of the developing bias at the time when a force generated to bias the toner charged with the regular charging polarity in a direction from the latent image carrier to the toner carrier is in maximum is Vmax, a voltage of the developing bias at the time when a force generated to bias the toner charged with the regular charging polarity in a direction from the toner carrier to the latent image carrier is in maximum is Vmin, the following equation is satisfied.

$$|V\min-Vo|\geqq|V\max-Vo|$$

The left-handed side of the above equation denotes a value of the strength of the electric field that generates the force of directing the regularly charged toner from the toner carrier to the non-image portion of the latent image carrier. On the other hand, the right-handed side thereof denotes a value of the strength of the electric field that generates the force of directing the regularly charged toner from the non-image portion of the latent image carrier to the toner carrier. In addition, in the description hereinafter, irrespective of the charged polarity, the direction of the charged toner from the toner carrier toward the latent image carrier is referred to as a "developing direction", and on the contrary, the direction from the latent image carrier toward the toner carrier is referred to as a "pullback direction".

Therefore, the above inequality denotes that the force that is exerted to the regularly charged toner between the toner carrier and the non-image portion of the latent image carrier by the electric field is large in the developing direction in comparison with the pullback direction. Accordingly, the regularly charged toner can securely be adhered to the non-image portion of the latent image carrier.

In addition, the abutting member of the cleaning unit may be a brush roller having a plurality of brush hairs that have a conducting property and are applied with a voltage having a polarity opposite to the regular charging polarity of the toner to abut the surface of the latent image carrier. According to the configuration, at the cleaning position, the brush hair is in contact with the toner adhered to the latent image carrier, so that the regularly charged toner can securely be removed, and the reversely charged toner can selectively remain on the latent image carrier.

Particularly, the brush roller rotates along with the latent image carrier. In other words, preferably, if the movement directions of the surface of the latent image carrier and the front end portion of the brush hair are designed to be the same at the cleaning position, the reversely charged toner cannot forcibly be scraped from the latent image carrier by the brush hair, so that the reversely charged toner can distributively remain on the latent image carrier.

The invention is particularly effective in the case where the neutralization of the latent image carrier is not performed between the transferring position and the charging position. If the voltage of the surface of the latent image carrier is reset by the neutralization, a large change in the voltage of the surface of the latent image carrier at the charging position is needed at the next time when the surface is charged. At this time, discharge occurs between the charging unit and the latent image carrier, and due to the discharge, so that the charged polarity of some portion of the reversely charged toner on the latent image carrier is inverted. Therefore, the effects of the invention are likely to be reduced. Accordingly, if the neutralization is not performed, the higher effects can be obtained.

In addition, the invention is effective even in the case where the volume average diameter of the toner is 5 μm or less. As described above, since micro-diameter toner has a large adhesive force to the toner carrier or the latent image carrier, it is difficult to separate the toner from the toner carrier or the latent image carrier by using the force of electric field or mechanically. This property is particularly dominant in the case where the volume average diameter of the toner is 5 μm or less. However, in the invention, since the operation is performed in the state where the toner is not forcibly removed but the reversely charged toner is actively distributed on the latent image carrier, particularly excellent effects can be obtained in the case where the micro-diameter toner is used. In other words, the invention provides a technology that is very suitable for implementing a toner having a small diameter.

BRIEF DESCRIPTION OF THE DRAWINGS

The invention will be described with reference to the accompanying drawings, wherein like reference numerals denote like elements.

DESCRIPTION OF EXEMPLARY EMBODIMENTS

Figure 1:
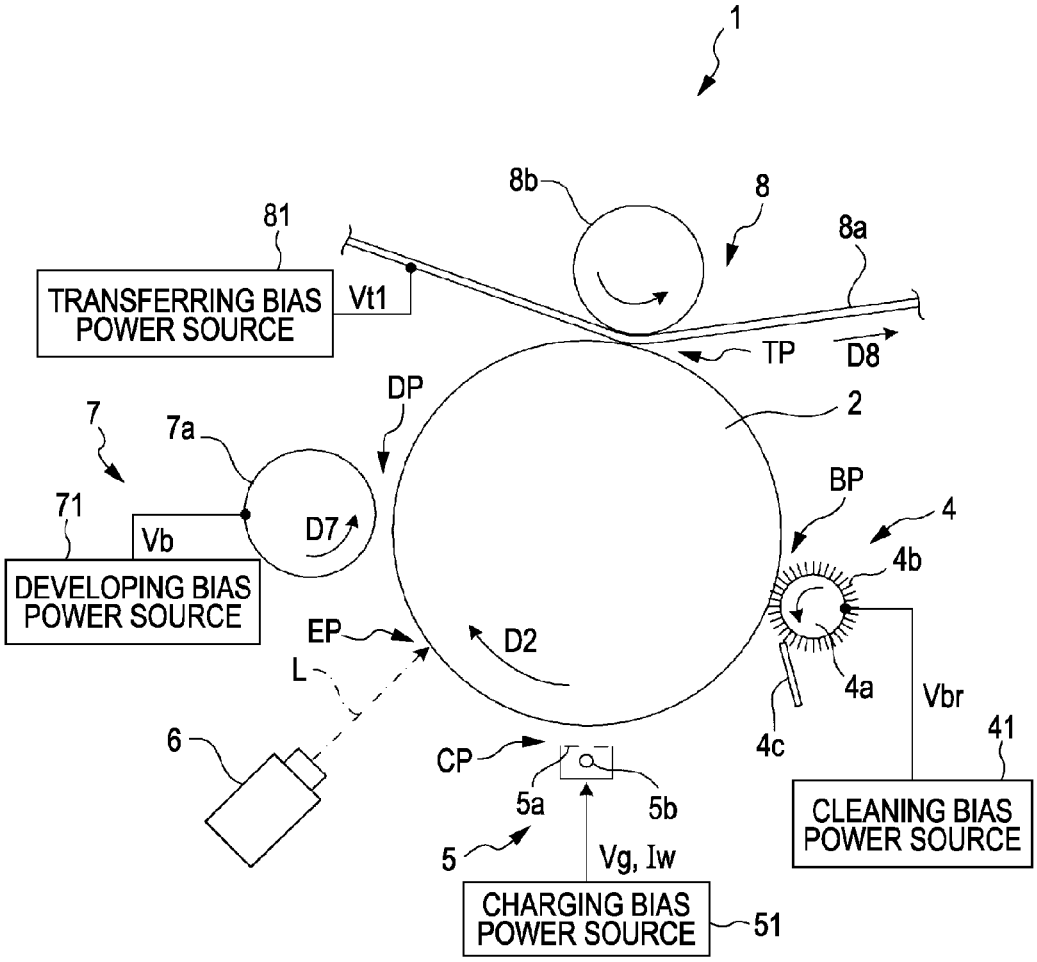
FIG. 1 is a view diagrammatically showing main components of an image forming apparatus according to an embodiment of the invention.
Figure 2:
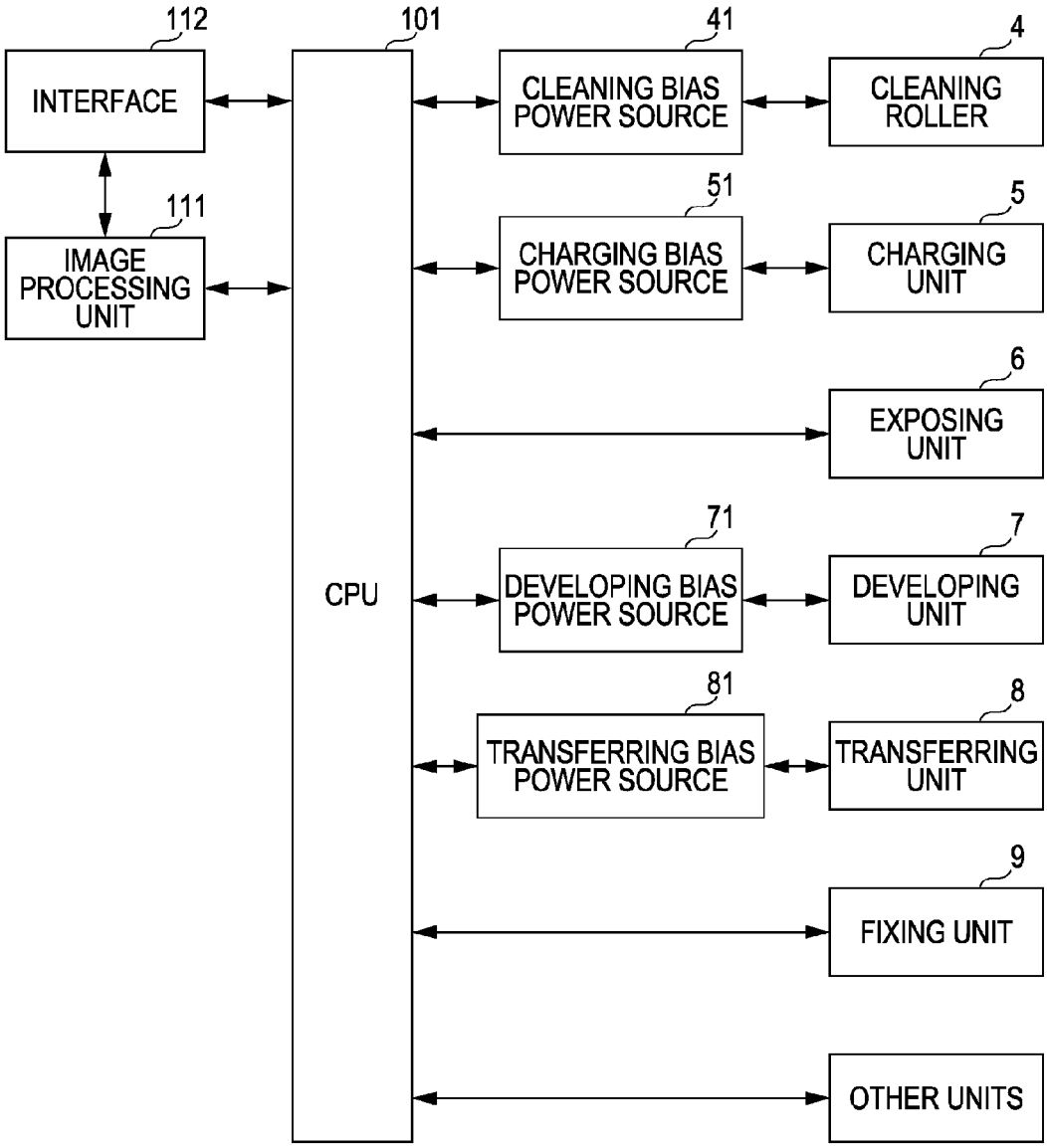
FIG. 2 is a block diagram showing an electrical configuration of the apparatus of FIG. 1.

FIG. 1 is a view diagrammatically showing main components of an image forming apparatus according to an embodiment of the invention. In addition, FIG. 2 is a block diagram showing an electrical configuration of the apparatus of FIG. 1. In the image forming apparatus 1 according to the embodiment, an image is formed by using a non-magnetic one-ingredient based negatively charged toner. In other words, in the embodiment, a negative polarity is a "regularly charged polarity". Needless to say, the image may be formed by using a positively charged toner, in which a positive polarity is the regularly charged polarity. Hereinafter, the description is made in the case where the image forming apparatus 1 uses the negatively charged toner. However, in the case where the image forming apparatus 1 uses the positively charged toner, charging voltages of elements may be replaced with the opposite voltages of those of the below description. In addition, although a toner has a toner core particle and external additive agent that are externally added to the toner core particle, simply-called a "toner" in the following description denotes the entire particle including the toner core particle and the external additive agent that are externally added thereto.

As shown in FIG. 1, in the embodiment, the image forming apparatus 1 includes a photoreceptor 2 on which are formed an electrostatic latent image and a toner image. The photoreceptor 2 is constructed with a photoreceptor drum. Similarly to a well-known photoreceptor drum, a photosensitive layer having a predetermined thickness is formed on an outer surface of a cylindrical metallic tube. As an example of the metallic tube of the photoreceptor 2, a conductive tube such as an aluminum tube is used. As an example of the photosensitive layer, a well-known organic photoreceptor is used.

A charging unit 5 that is a corona charging unit for charging a surface of the photoreceptor 2 with a predetermined voltage, an exposing unit 6 that forms an electrostatic latent image by exposing the surface of the photoreceptor 2 according to an image signal, a developing unit 7 that develops the electrostatic latent image as a toner image, a transferring unit 8 which transfers the toner image, and a cleaning roller 4 are disposed around the photoreceptor 2 in this order in a rotation direction D2 (clockwise in FIG. 1) of the photoreceptor 2.

The charging unit 5 is not in contact with the surface of the photoreceptor 2. As an example of the charging unit 5, a well-known corona charging unit may be used. In the case where a scorotron charging unit is used as the corona charging unit, a negative wire current Iw flows in a charge wire 5*b* of the scorotron charging unit, and a negative direct current (DC) grid charging bias Vg is applied to a grid 5*a*. The photoreceptor 2 is charged through corona discharge with the same polarity (negative polarity) as that of the toner by the charging unit 5, so that the voltage of the surface of the photoreceptor 2 is set to a substantially uniform negative voltage; more specifically, a voltage Vo that is set at the time of image forming.

The exposing unit 6 exposes the surface of the photoreceptor 2 with a light beam L according to an image signal applied from an external apparatus to form an electrostatic latent image corresponding to the image signal. More specifically, as shown in FIG. 2, if the image signal is applied through an interface 112 from the external apparatus such as a host computer that generates the image signal, a predetermined process is performed on the image signal by an image processing unit 111. The image signal is received by the exposing unit 6 through a CPU 101 that controls the entire operations of the apparatus. The exposing unit 6 performs the exposing by illuminating the surface of the photoreceptor 2 with the light beam L according to the image signal, so that in the exposed surface area (exposed portion) of the photoreceptor 2, electric charges are neutralized, and the voltage is changed into a surface voltage VL that is different from that of the non-exposed surface area (non-exposed portion). As a result, the electrostatic latent image corresponding to the image signal is formed on the photoreceptor 2.

A toner from the developing unit 7 is applied to the formed electrostatic latent image, so that the electrostatic latent image is developed by the toner. In the image forming apparatus 1 according to the embodiment, the developing unit 7 is a non-contact developing type developer where a developing roller 7*a* is not in contact with the photoreceptor 2. The developing roller 7*a* is disposed to face the photoreceptor 2 in separation with a predetermined gap. The developing roller 7*a* is driven to rotate in an arrow direction D7 of FIG. 1. A predetermined developing bias Vb from a developing bias power source 71 is applied to the developing roller 7*a*. As the structure of the developing unit 7 is described later in detail, a well-known non-contact developer is also used as the developing unit 7.

In addition, the transferring unit 8 is an endless belt of which surface can carry a toner image. The transferring unit 8 has an intermediate transfer belt 8*a* that circulates in an arrow direction D8 of FIG. 1. The intermediate transfer belt 8*a* is allowed to abut the surface of the photoreceptor 2 by a backup roller 8*b* that is disposed close to the photoreceptor 2. In addition, the intermediate transfer belt 8*a* is applied with a transferring bias Vt1 with a polarity opposite to the charged polarity of the toner from a transferring bias power source 81. Due to the operation thereof, the toner image developed on the photoreceptor 2 is transferred (preliminarily transferred) to the intermediate transfer belt 8*a*. Furthermore, the toner image transferred to the intermediate transfer belt 8*a* is secondarily transferred to a recording sheet (not shown). The toner image is permanently fixed on the recording sheet by the fixing unit 9 to be output.

The cleaning roller 4 includes a brush roller 4*a* that is rotatably configured. The brush roller 4*a* has a plurality of brush hairs 4*b* made of, for example, nylon. The brush hairs 4*b* are disposed to abut the surface of the photoreceptor 2. The brush roller 4*a* is configured to rotate in the overspined rotation with respect to the rotation of the photoreceptor 2, that in the so-called "along-with" rotation (the rotation where the direction of the tangential velocity of the rotation of the photoreceptor 2 is the same as the direction of the tangential velocity of the rotation of the brush hair 4*b* at the abutting portion between the photoreceptor 2 and the brush hair 4*b*).

The brush roller 4*a* is applied with a direct current (DC) cleaning bias Vbr having a polarity opposite to a regularly charged polarity of the toner, that is, a positive polarity. Therefore, the one charged with the regularly charged polarity among the transferred remaining toner and the external additive agent on the photoreceptor 2 passing through a position abutting the intermediate transfer belt 8*a* is attracted to the brush roller 4*a* to be adhered to the brush hair 4*b*. In addition, other conductive cleaning rollers such as a conductive rubber roller beside the brush roller can be used as the cleaning roller 4.

In addition, the cleaning roller 4 has a cleaning blade 4*c* that abuts the brush hair 4*b* of the brush roller 4*a*. The cleaning blade 4*c* removes the transferred remaining toner and the external additive agent adhered to the brush hair 4*b* to be recovered. A well-known cleaning blade can be used as the cleaning blade 4*c*.

In addition, in the description hereinafter, a position where the photoreceptor 2 faces the charging unit 5 is referred to as a charging position CP. A position where the surface of the photoreceptor 2 is illuminated with the light beam L from the exposing unit 6 is referred to as an exposing position EP. A position where the photoreceptor 2 faces the developing roller 7*a* is referred to as a developing position DP. A position where the photoreceptor 2 abuts the intermediate transfer belt 8*a* is referred to as a transferring position TP. A position where the cleaning roller 4 abuts the photoreceptor 2 is referred to as a cleaning position BP. In the embodiment, the positions are disposed in the above order from the upstream side toward the downstream side in the rotation direction D2 of the photoreceptor 2.

Figure 3:
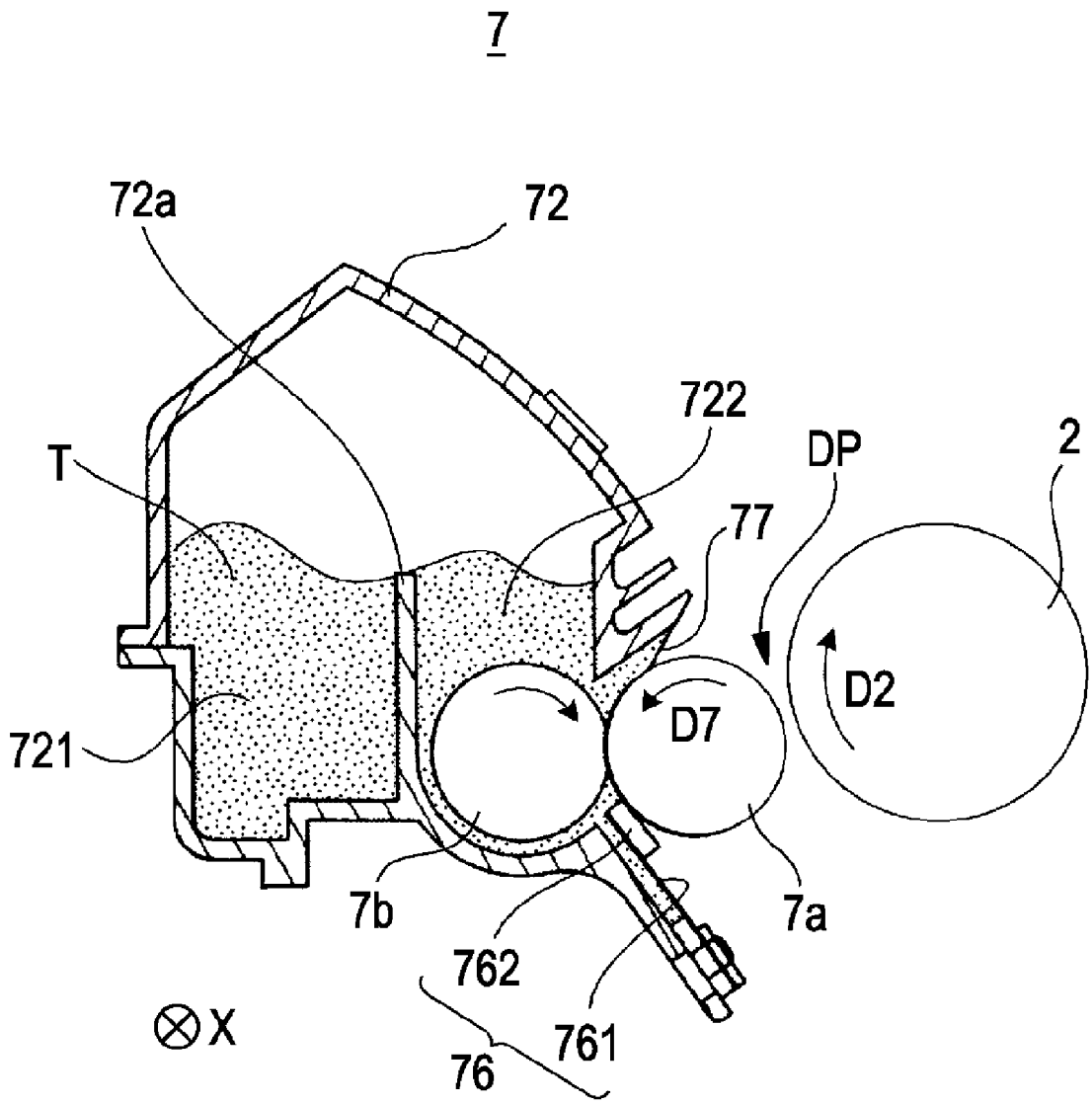
FIG. 3 is a cross-sectional view showing a structure of a developing unit according to the embodiment.

FIG. 3 is a cross-sectional view showing a structure of the developing unit 7 according to the embodiment. In the developing unit 7, a supplying roller 7*b* and a developing roller 7*a* are adhered through a shaft to a housing 72 which contains a non-magnetic one-ingredient based toner T inside thereof. The developing roller 7*a* is positioned to face the photoreceptor 2 with a predetermined separation gap at the developing position DP. The rollers 7*a* and 7*b* are engaged with a rotation driving unit (not shown) provided to the main body side to be rotated in a predetermined direction. The supplying roller 7*b* is formed in a shape of a cylinder and made of an elastic material such as a foamed urethane rubber and a silicon rubber. In addition, the developing roller 7*a* is formed in a shape of a cylinder and constructed with a metallic tube made of a conductive material, for example, a metal such as copper, aluminum, and stainless steel, or an alloy thereof. In addition, the two rollers 7*a* and 7*b* are rotated in a contacted state, so that the toner can be abrasively adhered to the surface of the developing roller 7*a*. Therefore, a toner layer having a predetermined thickness is formed on the surface of the developing roller 7*a*.

An inner space of the housing 72 is divided into a first chamber 721 and a second chamber 722 by a partition wall 72*a*. The supplying roller 7*b* and the developing roller 7*a* are disposed in the second chamber 722. Due to the rotation of the rollers, the toner inside the second chamber 722 is circulated and stirred to be supplied to the surface of the developing roller 7*a*.

In addition, in the developing unit 7, a regulating blade 76 for regulating a thickness of the toner layer formed on the surface of the developing roller 7*a* to a predetermined thickness is disposed. The regulating blade 76 is configured with a plate member 761 having elasticity such as stainless steel and phosphor bronze and an elastic member 762 made of a resin material such as a silicon rubber and an urethane rubber that is provided to a front end portion of the plate member 761. A rear end portion of the plate member 761 is fixed to the housing 72. In the rotation direction D7 of the developing roller 7*a* indicated by the arrow of FIG. 3, the elastic member 762 provided to the front end portion of the plate member 761 is disposed to be positioned at the upstream side from the rear end portion of the plate member 761. In addition, the elastic member 762 elastically abuts the surface of the developing roller 7*a*, so that a regulating nip is formed to finally regulate the toner layer formed on the surface of the developing roller 7*a* to a predetermined thickness.

In addition, the housing 72 is provided with a seal member 77 which is pressed on the surface of the developing roller 7*a* at the downstream side of the position (developing position DP) facing the photoreceptor 2 in the rotation direction D7 of the developing roller 7*a*. The seal member 77 is made of a material having flexibility such as polyethylene, nylon, and a fluorine resin. The seal member 77 is a stripe-shaped film that extends in a direction X parallel to a rotation axis of the developing roller 7*a*. In the transverse direction perpendicular to the longitudinal direction X, the one end portion is fixed to the housing 72, and the other end portion is allowed to abut the surface of the developing roller 7*a*. The other end portion is allowed to abut the developing roller 7*a* toward the downstream side in the rotation direction D7 of the developing roller 7*a*, that is, in the so-called trail direction, so that the toner remaining on the surface of the developing roller 7*a* passing the position facing the photoreceptor 2 is guided into the housing 72, and the toner in the housing can be prevented from being leaked out to an outer portion thereof.

Figure 4:
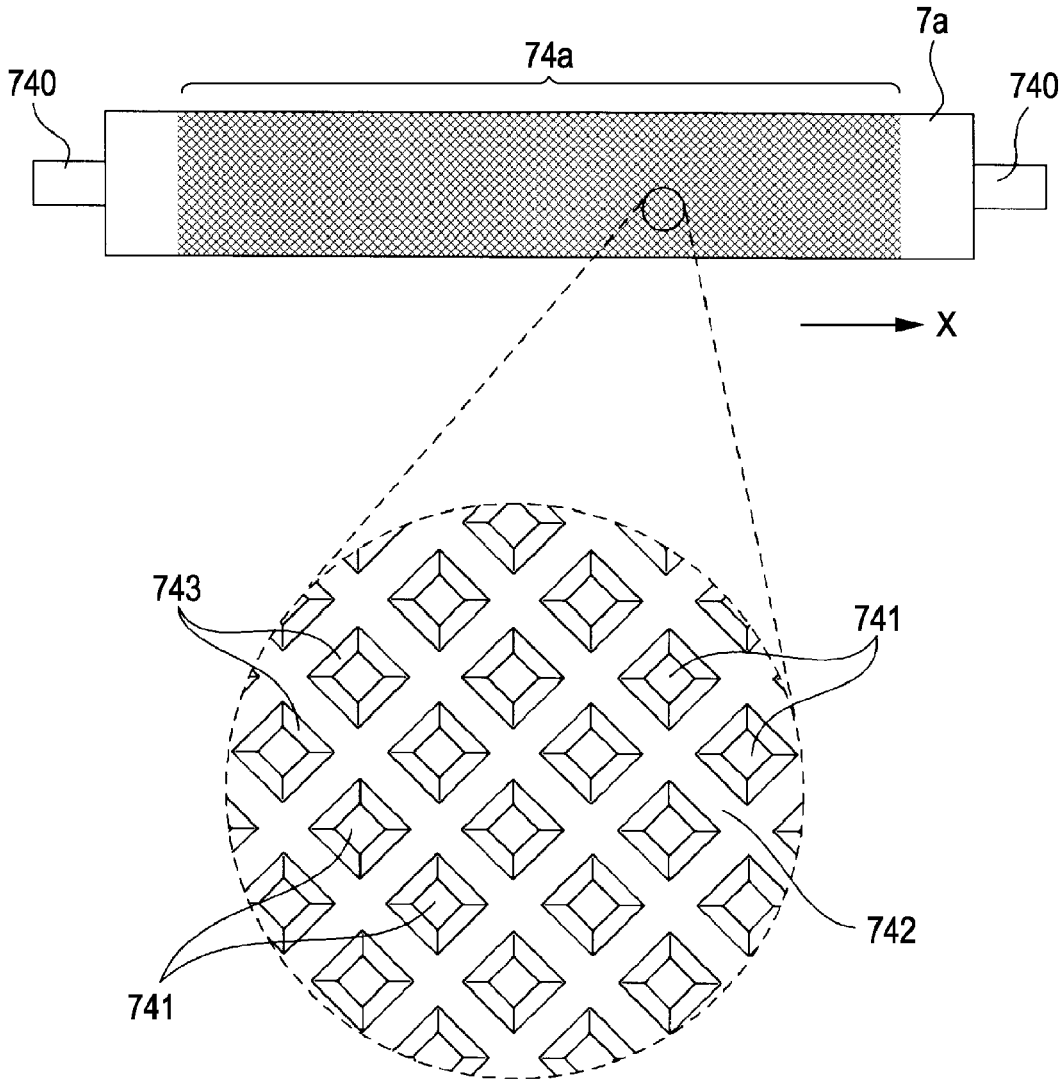
FIG. 4 is a view showing a developing roller and a partially enlarged view showing a surface thereof.

FIG. 4 is a view showing the developing roller 7*a* and a partially enlarged view showing a surface thereof. The developing roller 7*a*, of which surface is constructed with a metallic tube made of a conductive material, is formed in a shape of a substantially cylindrical roller. At the two ends in the longitudinal direction, a shaft 740 having the same axis as the roller is provided. The shaft 740 is supported by the main body of the developer, so that the entire developing roller 7*a* can be freely rotated. As shown in a partially enlarged view (inside a circle indicated by a dotted line) of FIG. 4, a plurality of convex portions 741 regularly arrayed and concave portions 742 surrounding the convex portions 741 are disposed in a central portion 74*a* of the surface of the developing roller 7*a*.

Each of the convex portions 741 protrudes toward the front side of the paper plane of FIG. 4. The top surface of each of the convex portions 741 constitutes a portion of a single cylindrical surface (enveloped cylindrical surface) having the same axis as the rotation axis of the developing roller 7*a*. In addition, the concave portions 742 are continuous grooves that surround the convex portions 741 in a net shape. The entire concave portions 742 constitutes another cylindrical surface that has the same axis as the rotation axis of the developing roller 7*a* and that is different from the cylindrical surface constituted by the convex portions. In addition, the convex portions 741 and the concave portions 742 surrounding thereof can be connected by gently sloped surfaces 743. In other words, each of the sloped surfaces 743 has a component in the outwardly radial direction of the developing roller 7*a*, that is, the direction separated from the rotation axis of the developing roller 7*a*.

The developing roller 7*a* having the structure can be manufactured through a manufacturing method using a so-called rolling process disclosed in, for example, JP-A-2007-140080. As a result, regular, uniform concave-convex portions can be formed on the cylindrical surface of the developing roller 7*a*. Therefore, the obtained developing roller 7*a* can carry a uniform and optimized amount of toner on the cylindrical surface thereof. In addition, a rolling ability (easiness of rolling) of the toner on the cylindrical surface of the developing roller 7*a* can be also uniform. As a result, local defects of charging or transporting of the toner can be prevented, so that excellent developing characteristics can be obtained. In addition, in order to form the concave-convex portions by using molds, unlike a general developing roller that can be obtained through a blast process, a width of the front end portion of the convex portion in the obtained concave-convex portion can be designed to be relatively large. Such a concave-convex portion has an excellent mechanical strength. Particularly, since the mechanical strength of the portion pressed by the molds is increased, the obtained concave-convex portion has an excellent mechanical strength in comparison with the concave-convex portion that is obtained through such a cutting process. The developing roller 7*a* having such concave-convex portions can have an excellent durability. In addition, if the width of the front end portion of the convex portion of the concave-convex portion is relatively large, the shape is not greatly changed by abrasion. Therefore, rapid deterioration in the development characteristics can be prevented, so that excellent development characteristics can be sustained for a long time.

Figure 5A:
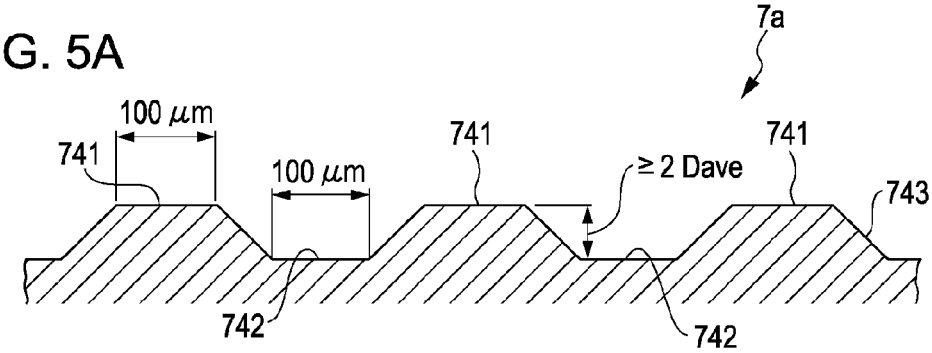
FIGS. 5A to 5D are detailed cross-sectional views showing a structure of the surface of the developing roller.

FIGS. 5A to 5D are detailed cross-sectional views showing a structure of the surface of the developing roller 7*a*. As shown in FIG. 5A, as the surface of the developing roller 7*a* is seen from the cross-sectional direction, the convex portions 741 protruding outwards from the circumferential surface and the concave portions 742 recessed therefrom are alternately arrayed. In addition, the convex portions 741 and the concave portions 742 are connected by the sloped surfaces 743. The size of the top surface of the convex portion 741 and the width of the concave portion 742 may be designed to be, for example, about 100 μm, but not limited thereto. On the other hand, a height difference between the convex portion 741 and the concave portion 742, that is, a depth of the concave portion 742 having a shape of groove surrounding the convex portion 741 is designed to be larger than the volume average diameter Dave of the toner used. Therefore, one or more layers of toner can be carried in the concave portions 742. In addition, since a large amount of the carried toner protrudes outwards from the top surface of the convex portions 741, a deterioration such as filling and deformation of the external additive agent caused from the rubbing abrasion by the regulating blade 76 or the seal member 77 can be avoided.

Figure 5B:
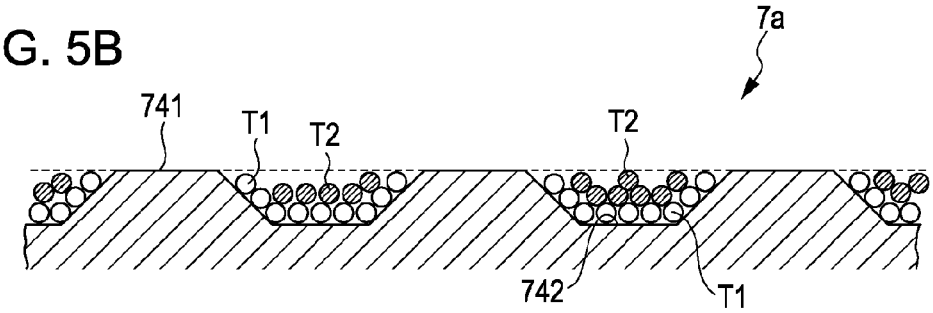

More preferably, as shown in FIG. 5A, a depth of the concave portions 742 is designed to be twice or more of the volume average diameter Dave (2 Dave). Therefore, as shown in FIG. 5B, two or more layers of toner can be carried in the concave portions 742 without protrusion outwards from a line (indicated by a broken line) connecting the top surfaces of the convex portions 741. In FIG. 5B, white circles indicated by reference numeral T1 denote the toners (contact toners) that are directly in contact with the surface of the developing roller 7*a*. In addition, hatched circles indicated by reference numeral T2 denote the toners (non-contact toners) that are not directly in contact with the surface of the developing roller 7*a* but carried in the concave portions 742. In this manner, the two or more toner layers includes both of the contact toners and the non-contact toners. Since the non-contact toner T2 has a weak binding force to the surface of the developing roller 7*a* in comparison with the contact toner T1, the non-contact toner T2 can easily be flown, and the flying amount of the toner can be increased, so that it is possible to effectively secure the image density. On the other hand, there is a problem in that the non-contact toner T2 can easily be separated to fly from the surface of the developing roller 7*a* by an airflow generated on the surface of the developing roller 7*a* caused from the rotation thereof due to the weak binding force.

In FIG. 5B, the line connecting the top surfaces of the convex portions 741 indicated by the broken line is a curved line of an enveloped cylindrical surface on the assumption that the top surface of each of the convex portions 741 is a portion of the one cylindrical surface. If the toner carried in the concave portions 742 does not exceed the line, there is no toner outside the enveloped cylindrical surface on the surface of the developing roller 7*a*. Therefore, although a strong airflow is generated on the surface of the developing roller 7*a* caused from the rotation of the developing roller 7*a*, the airflow cannot influence the toner carried at the position recessed from the surface of the developing roller 7*a*. In addition, the separation and flying of the non-contact toner having a weak binding force to the developing roller can be prevented.

Figure 5C:
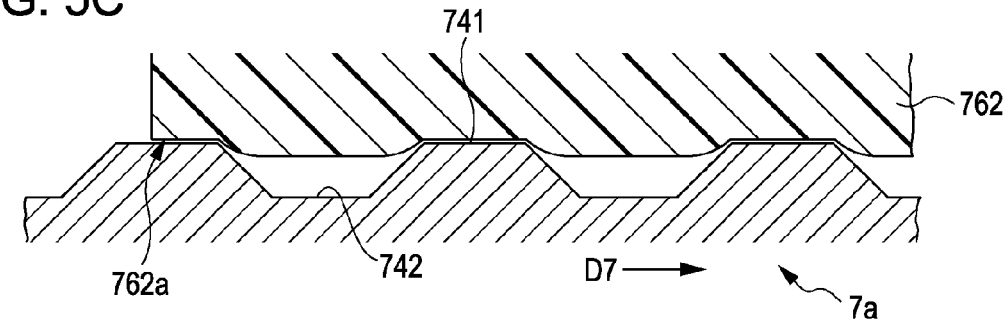

In order for the toner to be carried on the surface of the developing roller 7*a* as shown in FIG. 5B, the adhesion of the toner to the convex portions 741 is regulated by the so-called edge regulation where the upstream side edge 762*a* of the elastic member 762 of the regulating blade 76 in the rotation direction D7 of the developing roller is allowed to abut the convex portions 741 of the developing roller 7*a*, as shown in FIG. 5C. In addition, by selecting a member having suitable elasticity as the elastic member 762, the elastic member 762 at the position facing the concave portions 742 may slightly be protruded toward the concave portions 742. Therefore, the adhesion of the toner to the convex portions 741 can be regulated, and the toner can be prevented from exceeding the enveloped cylindrical surface to be carried in the concave portions 742.

Figure 5D:
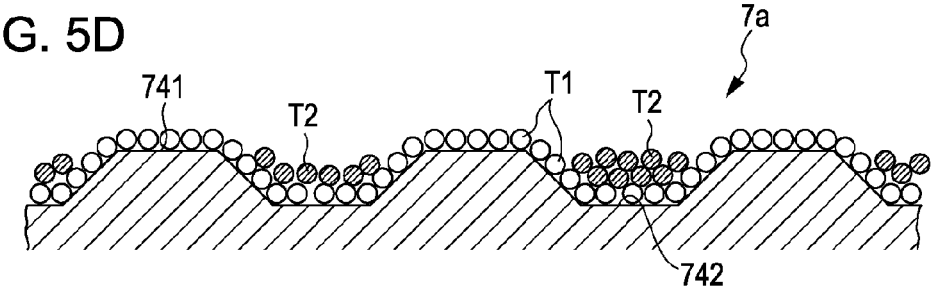

In addition, as described above, a strong binding force to the developing roller 7*a* is exerted on the contact toner. Therefore, it is considered that the contact toner has a relatively high resistance to the air flow and the detachment of the toner cannot easily occur even in the case where the toner is exposed to the outer portion of the enveloped cylindrical surface. From this point of view, as shown in FIG. 5D, the abutting angle or the abutting pressure of the regulating blade 76 may be adjusted so that the one or less toner layer is allowed to be adhered to the convex portions 741.

In addition, by carrying the toner only in the concave portions 742, the following effects can be obtained. First, in order to form a uniform toner layer in the convex portions 741, the gap between the regulating blade 76 and the convex portions 741 needs to be accurately managed. However, in order to carry the toner only in the concave portions 742, all the toner in the convex portions 741 may be removed by abutting the regulating blade 76 on the convex portions 741, so that the implementation thereof can relatively easily be obtained. In addition, the amount of the transported toner is defined by a volume of the space generated in the gap between the regulating blade 76 and the concave portions 742, so that the amount of the transported toner can be stabilized.

In addition, there is an advantage in that the layer of the transported toner is good. In other words, if the toner is carried in the convex portions 741, the deterioration of the toner caused from the rubbing abrasion of the regulating blade 76 can easily occur. More specifically, there is a problem in that the fluidity or the charging ability of the toner is deteriorated, in that the toner is pressed into the powdered state to be agglomerated, or in that the toner is fixed to the developing roller 7*a* to generate filming. However, the problem that the toner is carried in the concave portions 742 that is not largely pressed by the regulating blade 76 cannot easily occur. In addition, since the methods of slidingly contacting the regulating blade 76 to the toner carried in the convex portions 741 and the toner carried in the concave portions 742 are very different, the amount of the charged toner is predicted to be non-uniform. However, by carrying the toner only in the concave portions 742, such a variation can be suppressed.

In particular, recently, in order to implement a highly accurate image, to reduce toner consumption, and to reduce power consumption, the toner needs to have a micro-diameter, or the fixing temperature needs to be reduced. The configuration of the embodiment can cope with these requirements. Since the micro-diameter toner has a large saturated charged amount despite the slow start of the charging, there is a tendency that the charged amount of the toner carried in the convex portions 741 is greatly larger (over-charged) than that of the toner carried in the concave portions 742. Such a difference in the charged amount is reflected on the image as the so-called developing history. In addition, in the case of a low-melting-point toner, the fixing between the toners or the fixing to the developing roller 7*a* can easily occur due to the rubbing abrasion. However, in the configuration of the embodiment where the toner is carried only in the concave portions 742, such problems cannot easily occur.

In addition, although a diameter of the used toner is not specifically limited in the embodiment, in the case where a toner having a volume average diameter Dave of 5 μm or less is used, particularly excellent effects can be obtained. Since such a micro-diameter toner has a small diameter, a strong van de Walls force is exerted, so that the toner cannot easily fly from the developing roller 7*a*. In addition, due to a strong mirror image force exerted to the developing roller 7*a* made of a conductive material, the toner cannot easily fly from the developing roller 7*a*. Therefore, according to the developing scheme of the embodiment where more than one layer of the toner is carried in the developing roller 7*a* and any one of the contact toner and the non-contact toner is allowed to fly so as to be contributed to the developing operation, a particularly excellent effect can be obtained.

In addition, as about 5 μm is set to the boundary value, the toner having a volume average diameter equal to or smaller than the value has a property of powder as a dominant property, so that the behavior thereof is different from that of the toner having a larger diameter. For example, since the toner having a small diameter has a small mass, once the toner flies, the toner floats in the air for a long time. Therefore, the toner may be leaked out to an outer portion of the apparatus as well as an inner portion of the apparatus. In the apparatus according to the embodiment, since the toner flying can be effectively suppressed, such a problem does not occur even in the case where the toner having a small diameter is used.

Next, the toner employed in the image forming apparatus having the aforementioned configuration is described. In the image forming apparatus according to the embodiment, the electrostatic latent image is developed by using a non-magnetic one-ingredient based toner that is negatively charged. Hereinafter, the negative polarity which is the original charged polarity of the toner is referred to as a "regular polarity", and the positive polarity opposite thereto is referred to as a "reverse polarity". On the other hand, the particle such as a toner or an external additive agent of which absolute charged polarity is the positive polarity is referred to as a "positively charged particle", and the particle such as a toner or an external additive agent of which absolute charged polarity is the negative polarity is referred to as a "negatively charged particle". Therefore, the "positively charged toner" of which absolute charged polarity is the positive polarity is the "reversely charged toner" in the embodiment. On the other hand, the "negatively charged toner" of which absolute charged polarity is the negative polarity is the "regularly charged toner" in the embodiment.

Figure 6:
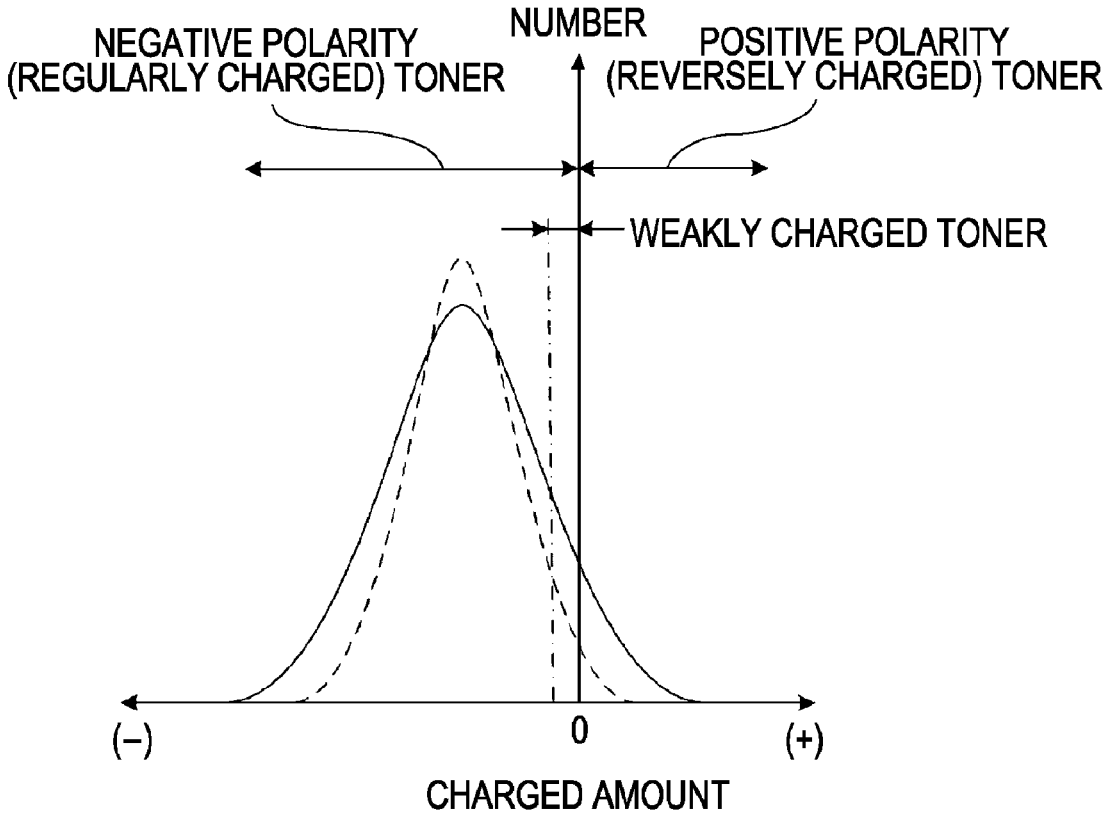
FIG. 6 is a view showing a distribution of a charged amount of a toner.

FIG. 6 is a view showing a distribution of a charged amount of a toner. The figure shows a result of measurement of a distribution of the charged amount of the toner that is collected from the surface of the developing roller on the basis of the number thereof. Although the regularly charged polarity of the toner used in the embodiment is the negative polarity, there is a variation in the charging characteristics of the toner as indicated by the solid line in FIG. 6, and the distribution of the charged amount substantially becomes the normal distribution. In the distribution, the toner that is not charged or the toner that is charged with a reverse polarity (in this case, the positive polarity) is included. Hereinafter, a toner having a small charged amount among the toners charged with the regularly charged polarity may particularly be referred to as a "weakly charged toner".

In addition, as described above, in the embodiment, since the toner is carried only in the concave portions 742 of the surface of the developing roller 7*a*, but not in the convex portions 741, the stress of the toner caused by the supplying roller 7*b* or the regulating blade 76 is reduced. Therefore, the variation in the charged amount caused from the deterioration of the toner can be reduced, so that a relatively narrow distribution of the charged amount can be obtained as indicated by the broken line in FIG. 6.

Figure 7:
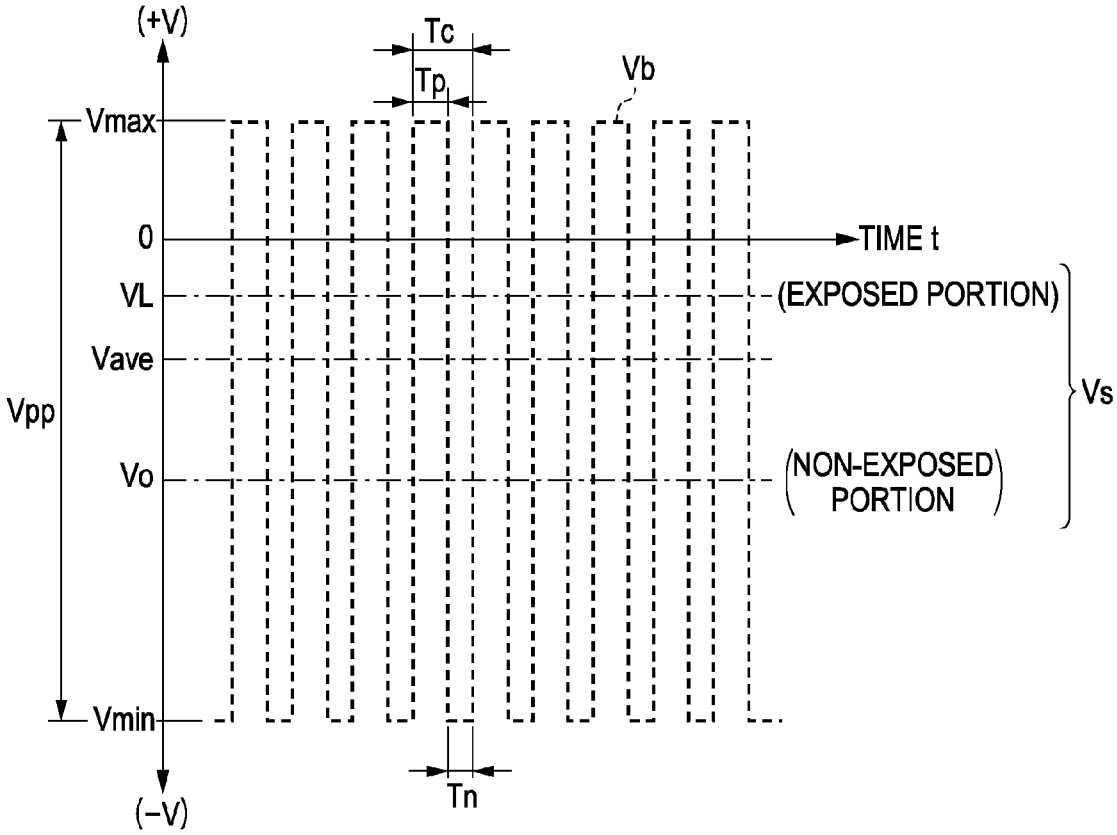
FIG. 7 is a view showing a relationship between voltages applied to components in the embodiment.

FIG. 7 is a view showing a relationship between voltages applied to portions in the embodiment. In the exposed portion which is charged by the charging unit 5 and, after that, illuminated with a light beam L from the exposing unit 6 so that the charges thereof are neutralized, the voltage Vs of the surface of the photoreceptor 2 becomes the voltage VL. On the other hand, in the non-exposed portion which is not exposed, the voltage Vs becomes the after-dark-attenuation voltage Vo. On the other hand, the developing bias Vb is a square-wave AC voltage as shown in FIG. 7. A positive-side maximum value thereof is denoted by reference numeral Vmax, and a negative-side maximum value thereof is denoted by reference numeral Vmin. A voltage difference (corresponding to an amplitude) therebetween is denoted by reference numeral Vpp. In addition, an average voltage of the developing bias Vb is denoted by reference numeral Vave.

In a repetition period Tc of an AC component of the developing bias Vb, a time interval where the voltage is oscillated at the positive side is denoted by Tp, and a time interval where the voltage is oscillated at the negative side is denoted by Tn. In this case, the waveform duty WD of the developing bias Vb can be defined by the following equation.

$$WD=Tp/(Tp+Tn)=Tp/Tc$$

As shown in FIG. 7, in the embodiment, a bias waveform is defined so that Tp>Tn, that is, the waveform duty WD is larger than 50%. Therefore, the time interval where the regularly charged toner is flying from the photoreceptor 2 to the developing roller 7*a* can be longer than the time interval of the reverse-direction movement. As a result, the regularly charged toner adhered to the non-exposed portion of the photoreceptor 2, that is, an area to which the toner is not to be originally adhered can effectively be pulled back to the developing roller 7*a*, so that the ground fogging can be suppressed.

Figure 8:
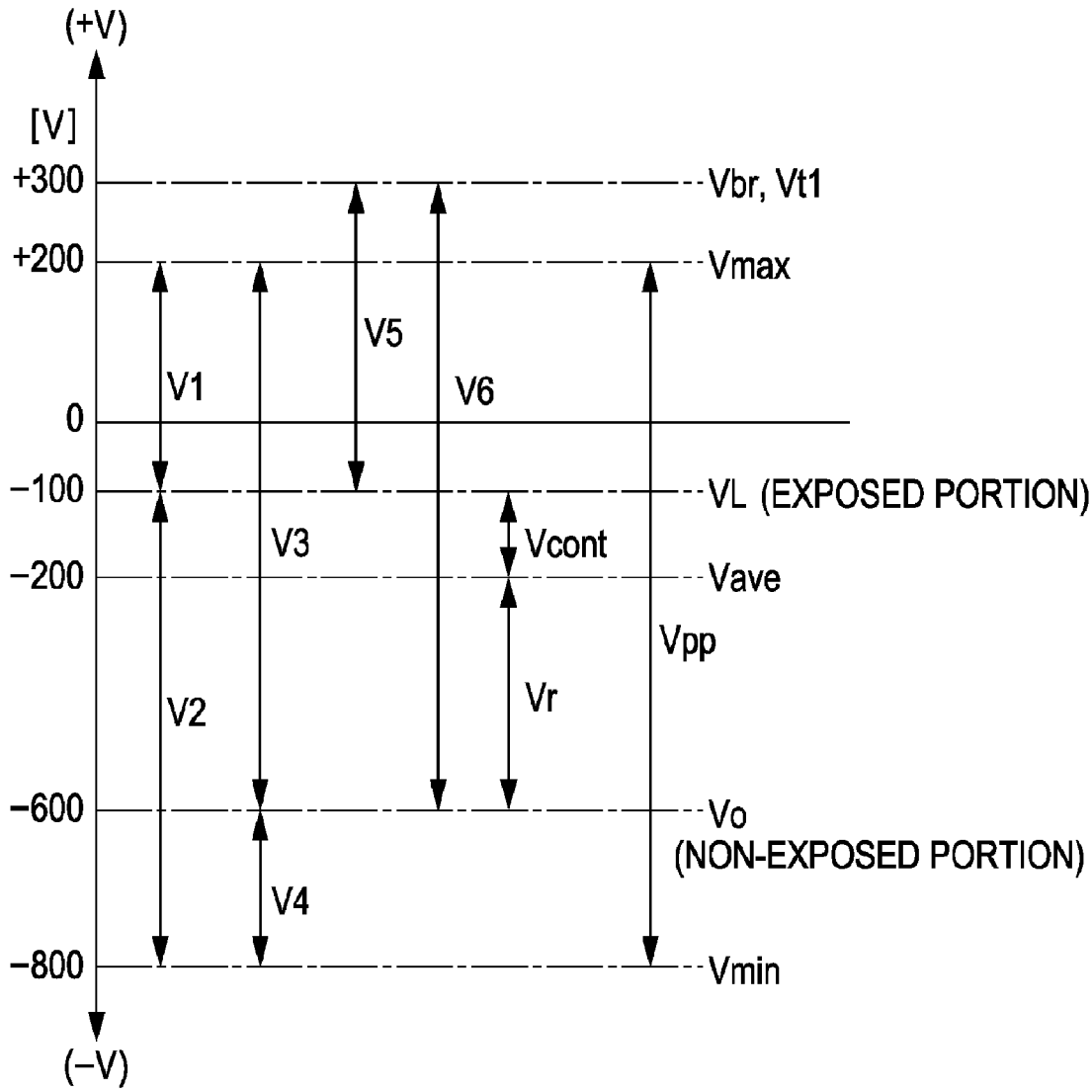
FIG. 8 is a view showing an example of numerical values of voltages of components.

FIG. 8 is a view showing an example of numerical values of voltages of the components. In addition, the disclosed numerical values are merely examples that satisfy the requisites of the invention. Therefore, the embodiment of the invention is not limited to the numerical values. The voltage Vo of the non-exposed portion of the photoreceptor 2 is representatively −600 V, but the voltage is variable in a range around the value. On the other hand, the voltage VL of the exposed portion is a value defined by characteristics of a material of the photoreceptor, which is set to −100 V. The positive-side maximum value Vmax and the negative-side maximum value Vmin of the developing bias Vb are +200 V and −800 V, respectively. Therefore, the amplitude Vpp is 1000 V. Since the waveform duty WD is 60%, the average voltage Vave of the developing bias Vb becomes −200 V. In addition, a frequency of the developing bias Vb is 4 kHz.

A voltage difference between the average value Vave of the developing bias Vb and the voltage VL of the exposed portion of the photoreceptor 2 is a parameter that influences an image density. The voltage difference is generally called "contrast voltage" denoted by reference numeral Vcont. On the other hand, a voltage difference between the average value Vave of the developing bias Vb and the voltage Vo of the non-exposed portion of the photoreceptor 2 is a parameter that influences toner flying or fogging at the developing position DP but merely influences the image density. The voltage difference is called "reverse contrast voltage" denoted by reference numeral Vr.

It is preferable that, in order to control the image density, the contrast voltage Vcont needs to be set as a variable value, and in order to stabilized the flying toner amount or the fogging amount, the reverse contrast voltage Vr needs to be maintained as a constant value. Therefore, in the embodiment, the parameters Vmax, Vmin, and WD of the developing bias Vb are set as variable values so as to control the average voltage Vave, so that a desired image density can be obtained. In addition, the charging bias Vg cooperates with a change in the average voltage Vave so as to change the voltage Vo of the non-exposed portion of the photoreceptor 2, so that the reverse contrast voltage Vr can be maintained as a constant value.

In addition, the transferring bias Vt1 applied to the intermediate transfer belt 8*a* and the cleaning bias Vbr applied to the brush roller 4 are +300 V. However, these do not necessarily have the same value.

In addition, for the description hereinafter, the reference numerals V1 to V6 are defined as follows. Reference numeral V1 denotes the absolute value of the voltage difference between the positive-side maximum value Vmax of the developing bias Vb and the voltage VL of the exposed portion of the photoreceptor 2. Reference numeral V2 denotes the absolute value of the voltage difference between the negative-side maximum value Vmin of the developing bias Vb and the voltage VL of the exposed portion of the photoreceptor 2. Reference numeral V3 denotes the absolute value of the voltage difference between the positive-side maximum value Vmax of the developing bias Vb and the voltage Vo of the non-exposed portion of the photoreceptor 2. Reference numeral V4 denotes the absolute value of the voltage difference between the negative-side maximum value Vmin of the developing bias Vb and the voltage Vo of the non-exposed portion of the photoreceptor 2. Reference numeral V5 denotes the absolute value of the voltage difference between the transferring bias Vt1 and the voltage VL of the exposed portion of the photoreceptor 2. In addition, reference numeral V6 denotes the absolute value of the voltage difference between the transferring bias Vt1 and the voltage Vo of the non-exposed portion of the photoreceptor 2.

Figure 9A:
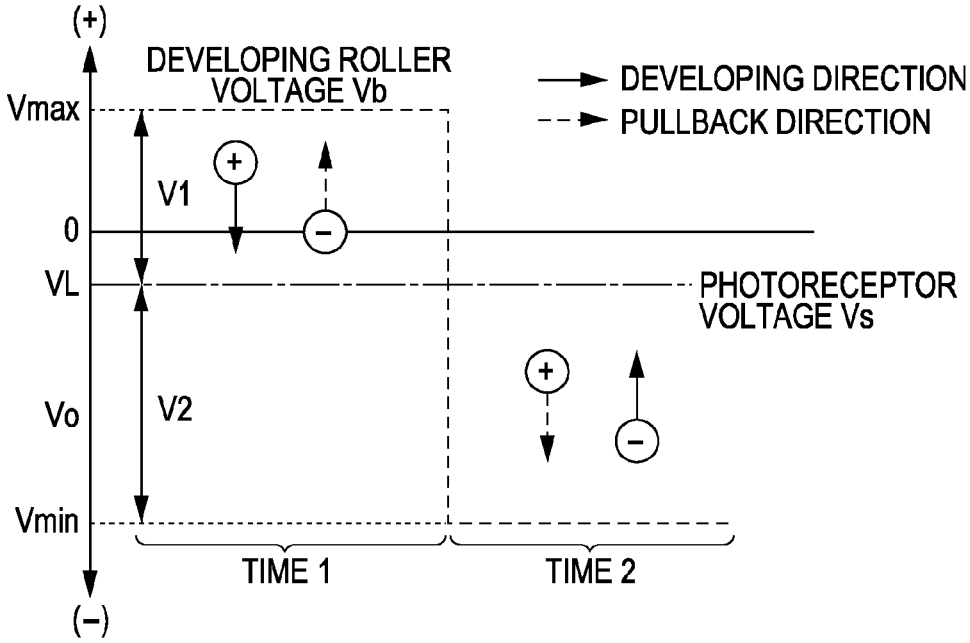
FIGS. 9A and 9B are views diagrammatically showing influence of voltages of portions to charged particles.
Figure 9B:
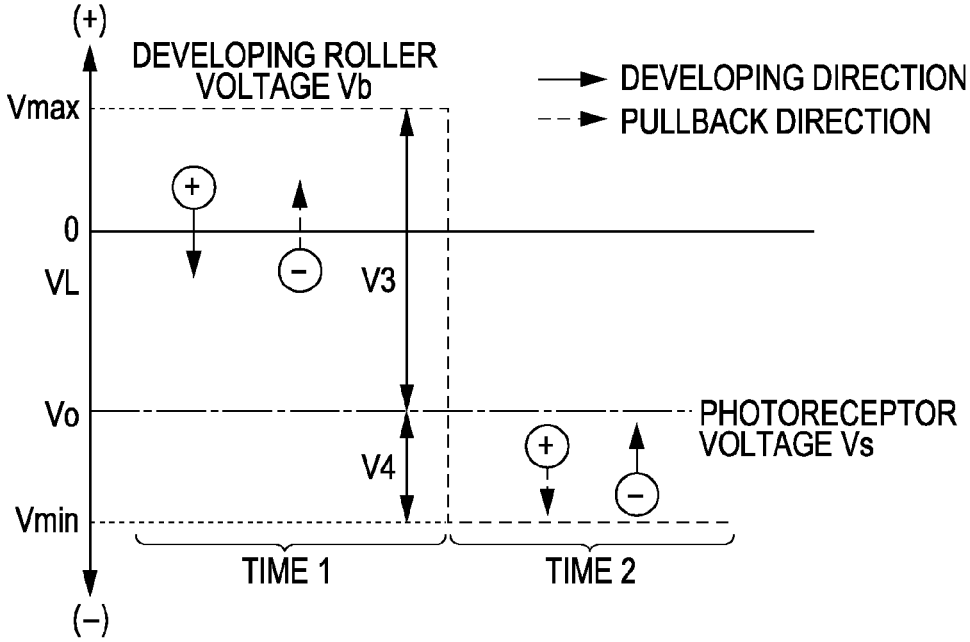

FIGS. 9A and 9B are views diagrammatically showing influence of voltages of portions to charged particles. More specifically, FIG. 9A is a view showing influence of the voltages of the exposed portion of the photoreceptor 2 and the developing roller 7*a* on the charged particles (toners and external additive agents). In addition, FIG. 9B is a view showing influence of the voltages of the non-exposed portion of the photoreceptor 2 and the developing roller 7*a* on the charged particles. In the figures, circles indicated by "+" denote positively charged particles (positively charged particles). In addition, circles indicated by "−" denote negatively charged particles (negatively charged particles). In addition, in the description hereinafter, irrespective of the charged polarity, a direction in which the charged toner is directed from the toner carrier to the latent image carrier is referred to as a "developing direction", and on the contrary, a direction in which the charged toner is directed from the latent image carrier to the toner carrier is referred to as a "pullback direction".

At the time point (time interval 1) when the developing bias Vb is oscillated at the positive-side value Vmax, the developing roller 7*a* is at the high voltage level with respect to any one of the exposed portion and the non-exposed portion of the photoreceptor 2. Therefore, the electric field generated at the developing position DP generates a developing direction force directing from the developing roller 7*a* to the photoreceptor 2 and exerts the force to the positively charged particle. Among the toners that are moved to the surface of the photoreceptor 2 by the force, the toner adhered to the non-exposed portion causes fogging. On the contrary, a pullback direction force pulling back from the photoreceptor 2 to the developing roller 7*a* is exerted to the negatively charged particle.

On the other hand, at the time point (time interval 2) when the developing bias Vb is oscillated at the negative-side value Vmin, the pullback direction force is exerted to the positively charged particle, and the developing direction force is exerted to the negatively charged particle. Among the negatively charged toners that are moved to the surface of the photoreceptor 2 by the force, the toner adhered to the exposed portion functions as the toner for developing the electrostatic latent image.

Figure 10:
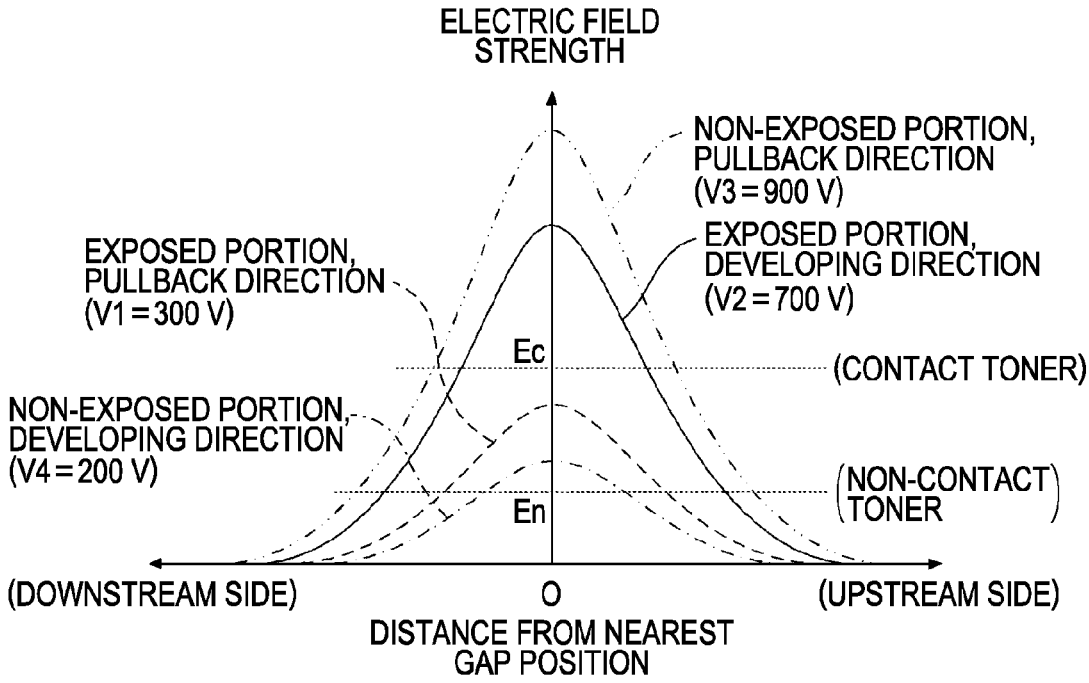
FIG. 10 is a view showing a distribution of electric field strength in the vicinity of the surface of the developing roller.

FIG. 10 is a view showing a distribution of electric field strength in the vicinity of the surface of the developing roller 7*a*. The horizontal axis of the graph in FIG. 10 denotes positions on the surface of the developing roller 7*a* as the developing position DP is viewed in the rotation-axis direction of the developing roller 7*a*. In other words, at the developing position DP where the photoreceptor 2 and the developing roller 7*a* that have substantially cylindrical shapes are disposed to face each other, the nearest position (closest gap position) thereof is set to the origin O, and each of the positions on the circumferential surface of the developing roller 7*a* are indicated by distances from the origin O. In addition, the vertical axis denotes the strength of the electric field that is generated by the developing bias Vb at each of the positions. In FIG. 10, the "developing direction" and the "pullback direction" are the directions in the case where the particles charged with the regularly charged polarity, that is, the negatively charged particles are focused.

The developing direction electric field strength between the exposed portion of the photoreceptor 2 and the developing roller 7*a* indicated by a solid line in FIG. 10 is obtained by removing the voltage difference V2 (700 V) shown in FIG. 9A with a size of the gap. The developing direction electric field strength is maximized at the closest gap position, where the gap is the smallest, and it is gradually lowered leftwards and rightwards from the position. In addition, the pullback direction electric field strength between the exposed portion of the photoreceptor 2 and the developing roller 7*a* indicated by a broken line in FIG. 10 is obtained by removing the voltage difference V1 (300 V) shown in FIG. 9A with the size of the gap. Therefore, in the space between the exposed portion of the photoreceptor 2 and the developing roller 7*a*, the developing direction electric field strength is larger than the pullback direction electric field strength.

In addition, the developing direction electric field strength between the non-exposed portion of the photoreceptor 2 and the developing roller 7*a* indicated by a one-dot dashed line in FIG. 10 is obtained by removing the voltage difference V4 (200 V) shown in FIG. 9B with the size of the gap. Therefore, the electric field strength has the lowest value. In addition, the pullback direction electric field strength between the non-exposed portion of the photoreceptor 2 and the developing roller 7*a* indicated by a two-dot dashed line in FIG. 10 is obtained by removing the voltage difference V3 (900 V) shown in FIG. 9B with the size of the gap. Therefore, the electric field strength has the highest value.

In FIG. 10, the value Ec is the electric field strength (hereinafter, referred to as a "contact toner flying start electric field strength") required for the toner (contact toner), which is carried to be directly in contact with the surface of the developing roller 7*a*, to start flying from the surface of the developing roller 7*a*. In addition, the value En is the electric field strength (hereinafter, referred to as a "non-contact toner flying start electric field strength") required for the toner (non-contact toner), which is indirectly carried in the developing roller 7*a* not to be directly in contact with the surface of the developing roller 7*a* but to be in contact with the contact toner on the developing roller 7*a*, to start flying from the surface of the developing roller 7*a*. The contact toner is strongly bound to the developing roller 7*a* by an adhesive force mainly caused from a mirror image force. On the contrary, the non-contact toner that is carried at the position apart from the surface of the developing roller 7*a* is weakly bound. Therefore, the non-contact toner can more easily fly, and the non-contact toner flying start electric field strength En is lower than the contact toner flying start electric field strength Ec.

In the embodiment, the developing direction electric field generated between the exposed portion of the photoreceptor 2 and the developing roller 7*a* indicated by the solid line in FIG. 10 is designed to be higher than the contact toner flying start electric field strength Ec. Therefore, both of the contact toner and the non-contact toner can fly from the surface of the developing roller 7*a* facing the exposed portion of the photoreceptor 2. Accordingly, by flying both of the contact toner and the non-contact toner, the exposed portion of the photoreceptor 2 can be developed with a sufficient image density.

On the other hand, the developing direction electric field generated between the non-exposed portion of the photoreceptor 2 and the developing roller 7*a* indicated by the one-dot dashed line in FIG. 10 is designed to be higher than the non-contact toner flying start electric field strength En and lower than the contact toner flying start electric field strength Ec. Therefore, only the non-contact toner flies between the non-exposed portion of the photoreceptor 2 and the developing roller 7*a*. If the flying non-contact toner is directly in contact with the surface of the photoreceptor 2, due to exertion of the strong adhesive force caused from the mirror image force, the non-contact toner cannot fly again by the pullback direction electric field, so that the non-contact toner may remain on the surface of the photoreceptor 2. In addition, since the developing direction and the pullback direction of the positively charged particles are opposite to those of the negatively charged particle, a strong developing direction force is exerted to the non-exposed portion of the photoreceptor 2.

As a result, mainly the positively charged particles and particles (weakly charged toner and external additive agents; hereinafter, collectively referred to as "weakly charged particle") having a relatively small charged amount, which are carried non-contactively on the surface of the developing roller 7*a* originally, are adhered to the non-exposed portion of the photoreceptor 2 passing the developing position DP.

Figure 11:
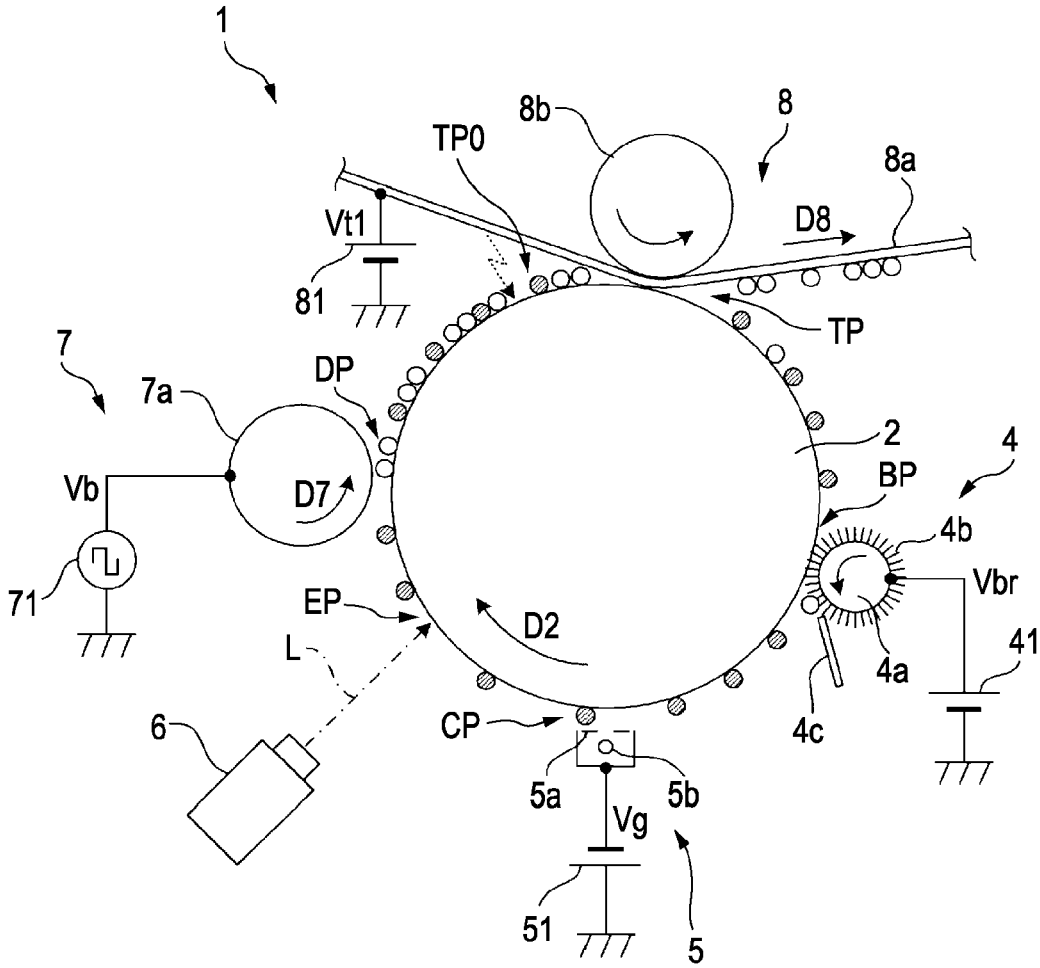
FIG. 11 is a view diagrammatically showing a development occurring on a surface of a photoreceptor.

FIG. 11 is a view diagrammatically showing development occurring on a surface of the photoreceptor 2. As described above, in the surface of the photoreceptor 2 passing the developing position DP, the negatively charged particles are mainly adhered to the exposed portion, so that the electrostatic latent image is developed, and the positively charged particles and the weakly charged particles are mainly thinly adhered to the non-exposed portion. In this state, the photoreceptor 2 moves toward the transferring position TP. The intermediate transfer belt 8*a* is applied with the transferring bias Vt1 having the positive polarity. In terms of the magnitude thereof, the voltage difference V5 (refer to FIG. 8) between the intermediate transfer belt 8*a* and the exposed portion of the photoreceptor 2 is set to a value that does not exceed the discharging start voltage between the intermediate transfer belt 8*a* and the photoreceptor 2, and the voltage difference V6 between the intermediate transfer belt 8*a* and the non-exposed portion of the photoreceptor 2 is set to a value that exceeds the discharging start voltage. In a photoreceptor having a layer thickness of 25 μm as a configuration of a general apparatus, the discharging start voltage is about 600 V. If the transferring bias Vt1 is set to +300 V as shown in FIG. 8, V5 becomes 400 V, and V6 becomes 900 V. Accordingly, the aforementioned condition is satisfied.

Under the condition, discharge from the intermediate transfer belt 8*a* toward the non-image portion of the photoreceptor 2 occurs. The discharge occurs at the front-side position TP0 of the transferring position TP in the rotation direction D2 of the photoreceptor 2, so that charges are injected to the toner or the external additive agents adhered to the non-exposed portion of the photoreceptor 2 by the discharge. Therefore, the charged amount of the positively charged particles is increased, and the weakly charged particles are changed to the positively charged particles by the polarity inversion thereof. Accordingly, most of the particles adhered to the non-exposed portion becomes the positively charged particles. Due to the discharge, the voltage of the non-image portion of the photoreceptor 2 is neutralized by the value exceeding the discharge limit, and the non-image portion is moved to the transferring position TP in the state. Therefore, the voltage of the non-image portion of the photoreceptor 2 after passing the position TP0 becomes −300 V. In addition, since the discharge does not occur at the position TP0 with respect to the image portion, the voltage of the image portion of the photoreceptor 2 is maintained at −100 V.

At the transferring position TP, the intermediate transfer belt 8*a*, to which the positive polarity transferring bias Vt1 is applied, abuts the surface of the photoreceptor 2, so that the negatively charged particles on the photoreceptor 2 are transferred to the intermediate transfer belt 8*a*. The negatively charged toner adhered to the exposed portion of the surface of the photoreceptor 2 is transferred as a toner image to the intermediate transfer belt 8*a*. However, the negatively charged toner adhered to the non-exposed portion causes ground fogging on the toner image. In the embodiment, since the polarity of the negatively charged particles in the non-exposed portion is inverted as described above, the ground fogging can be suppressed.

On the other hand, due to the application of the positive polarity transferring bias Vt1, the positively charged particles are not transferred to the intermediate transfer belt 8*a* but remains on the photoreceptor 2 to be moved to the cleaning position BP. At the cleaning position BP, since the brush roller 4*a* abutting the photoreceptor 2 is also applied with the positive-polarity cleaning bias Vbr, the operation of collecting the positively charged particles adhered to the photoreceptor 2 does not occur. Particularly, by rotating the brush roller 4*a* along with the photoreceptor 2, the operation of scraping the positively charged particles by the brush can be suppressed to be low.

Since the transfer efficiency is 100% or less, the transferred remaining negatively charged particles may remain on the surface of the exposed portion of the photoreceptor 2 passing the transferring position TP. Due to the abutting on the brush roller 4*a*, the negatively charged particles are supplied with positive charges so that the negatively charged particles are changed to have the positive polarity. Otherwise, due to the adhesion to the brush hair 4*b*, the negatively charged particles are removed from the surface of the photoreceptor 2. As a result, the downstream side of the cleaning position BP is in the state where almost only the positively charged particles are adhered to the surface of the photoreceptor 2.

Since the positively charged particles are non-contractive, the positively charged particles cannot be adhered to the charging unit 5 and pass the charging position CP and the exposing position EP to reach the developing position DP again. Since positively charged particles, of which charged amount is increased during the circulation, are already adhered to the surface of the photoreceptor 2 that returns to the developing position DP, the adhesive force exerted to the photoreceptor 2 can be weakened, so that the adhesion of newly positively charged particles cannot easily occur. In addition, although the negatively charged particles are adhered to the non-exposed portion by the reciprocating motion according to the alternating electric field, since the adhesive force of the photoreceptor 2 is reduced, the positively charged particles can easily return to the developing roller 7*a* under the pullback direction electric field. In other words, in the embodiment, the image forming process can be performed in the state where an almost constant amount of the positively charged particles are distributively adhered to the photoreceptor 2.

Figure 12:
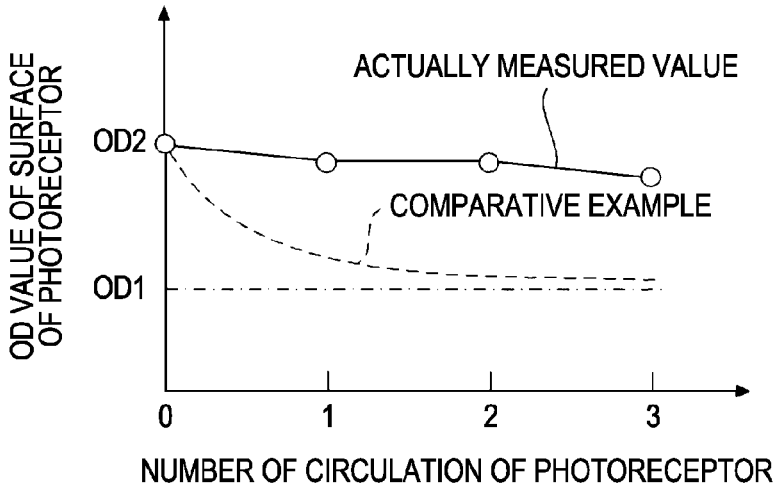
FIG. 12 is a view showing a result of actual measurement of a change in remaining toner amount on the photoreceptor.

FIG. 12 is a view showing a result of actual measurement of a change in remaining toner amount on the photoreceptor 2. An experiment is performed as follows. The positively charged particles are adhered to the surface of the photoreceptor 2 by the aforementioned process. At the time when a developer, in which no toner is contained, is installed in the apparatus and operated, a change in a toner amount adhered to the photoreceptor 2 is measured by an optical density (OD) of the surface of the photoreceptor 2. As a result, as shown in FIG. 12, it can be seen that, although circulation of the photoreceptor 2 is repeated, the OD value of the surface is not almost changed from an initial value OD2 and the toner of the photoreceptor 2 is not almost removed. In FIG. 12, the broken line indicates, as a comparative example, a change in the OD value predicted in a general image forming apparatus that is configured to recover the remaining material on the photoreceptor or to scrape the remaining material by using a cleaning blade. In addition, the value OD1 indicated by the one-dot dashed line is the OD value of a single body of the photoreceptor 2, that is, the OD value at the time when no toner is adhered. In addition, it can be seen that, at the time when the developer charged with the toner is installed and operated in the state where no toner is adhered to the photoreceptor 2, the OD value is firstly increased, but the OD value is finally an almost constant value, that is, the value OD2 shown in FIG. 12, so that the adhesion amount is saturated.

However, in the aforementioned embodiment, as shown in FIG. 8, the voltages of the components are set so that the voltage difference V2 between the voltage VL of the exposed portion of the photoreceptor 2 and the negative-side maximum value Vmin of the developing bias Vb becomes 700 V, and the voltage difference V4 between the voltage Vo of the non-exposed portion of the photoreceptor 2 and the negative-side maximum value Vmin of the developing bias Vb becomes 200V. The reason for the setting is described as follows.

Figure 13:
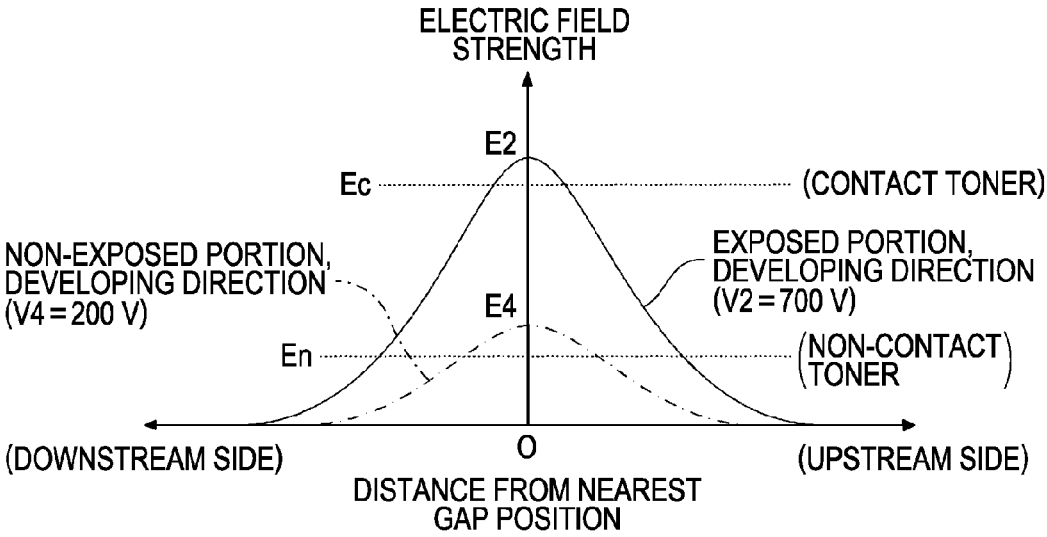
FIG. 13 is a view showing electric field strengths in the developing direction in an exposed portion and a non-exposed portion.

FIG. 13 is a view showing electric field strengths in the developing direction in an exposed portion and a non-exposed portion. As described above, in order to obtain a sufficient developing density, it is preferable that the contact toner is allowed to fly between the exposed portion of the photoreceptor 2 and the developing roller 7*a*. For this reason, as shown in FIG. 13, at least at the closest gap position, the developing direction electric field strength E2 in the exposed portion needs to be larger than the contact toner flying start electric field strength Ec. On the other hand, according to the feature of the embodiment, in order to implement the adhesion of the non-contact toner to the non-exposed portion of the photoreceptor 2, at the closest gap position, the developing direction electric field strength E4 in the non-exposed portion needs to be larger than at least the non-contact toner flying start electric field strength En.

Even in the case where the developing direction electric field strength E2 in the exposed portion is minimized, that is, almost equal to the contact toner flying start electric field strength Ec, in order to adhere the non-contact toner to the non-exposed portion, as can be understood from FIG. 13, it is preferable that a relationship of the following equation rather than E4>E2×(En/Ec) is satisfied.

$$E2/E4<Ec/En \quad \text{(Equation 1)}$$

In other words, it is preferable that the ratio of the developing direction electric field strength E2 in the exposed portion to the developing direction electric field strength E4 in the non-exposed portion is smaller than the ratio of the contact toner flying start electric field strength Ec to the non-contact toner flying start electric field strength En.

Herein, in the gap, the electric field strengths E2 and E4 are proportional to the voltage differences V2 and V4 between the developing roller 7*a* and the photoreceptor 2. In addition, it is considered that the electric field strengths En and Ec required to fly the toner from the developing roller 7*a* is proportional to a magnitude of the adhesive force by which the toner is bound to the developing roller 7*a*. Therefore, if the adhesive force that the developing roller 7*a* exerts to the contact toner is denoted by Fc, and the adhesive force that the developing roller 7*a* exerts to the non-contact toner is denoted by Fn, the aforementioned Equation 1 can be reduced as follows. Accordingly, the following equation can be obtained.

$$E2/E4=V2/V4=|V\min-VL|/|V\min-Vo|<Fc/Fn \quad \text{(Equation 2)}$$

If the above relationship is satisfied and the developing direction electric field strength E2 in the exposed portion is larger than the contact toner flying start electric field strength Ec, the transferring of the non-contact toner to the non-exposed portion of the photoreceptor 2 can securely be performed.

If the adhesive force exerted to the charged toner is mainly the mirror image force, the magnitude of the adhesive force is reversely proportional to a square of a distance from the surface of the developing roller 7*a*. Assuming that the charge of the toner is concentrated on the center thereof, the distance between the charges of the contact toner and the developing roller 7*a* is 0.5r, where r is the diameter of the toner. On the other hand, with respect to the non-contact toner, in case of a hexagonal close-packed arrangement where the center thereof is the closest to the developing roller 7*a*, the mirror image force is maximized. In this case, the distance between the center of the toner and the developing roller 7*a* is about 1.32r. Therefore, a ratio of the mirror image forces, that is, a ratio of the adhesive forces can be expressed by the following equation.

$$Fc/Fn=\{(1/0.5r)/(1/1.32r)\}^2=(1.32/0.5)^2\approx 7 \quad \text{(Equation 3)}$$

Therefore, as a simpler equation that Equations 2 and 3, the following equation can be obtained.

$$|V\min-VL|/|V\min-Vo|<7 \quad \text{(Equation 4)}$$

If the above equation is satisfied, the transferring of the non-contact toner to the non-exposed portion of the photoreceptor 2 can securely be performed. In the numerical example of the embodiment, V2/V4=700/200=3.5<7, so that the relationship of the above equation 4 is satisfied.

In this manner, in the embodiment, in the non-contact AC jumping developing type image forming apparatus where the photoreceptor 2 carrying the electrostatic latent image and the developing roller 7*a* carrying the toner is disposed to non-contactively face each other, provided is the charging unit 5 which allows both of the contact toner that is directly in contact with the surface of the developing roller 7*a* and the non-contact toner that does not contact with the surface of the developing roller 7*a* to be carried in the developing roller 7*a* and which non-contactively charges the surface of the photoreceptor 2. In addition, by applying the positive-polarity biases Vt1 and Vbr to the intermediate transfer belt 8*a* and the cleaning roller 4, the charged polarity of the negatively charged particles adhered to the non-exposed portion of the photoreceptor 2 is inverted.

According to such a configuration, the image forming process is performed in the state where a constant amount of the positively charged particles are distributively adhered to the photoreceptor 2. Since the positively charged particles are not almost increased during the process, after the positively charged particles are firstly consumed so as to be supplied on the photoreceptor 2, there is no additional toner consumption. Therefore, in comparison with the related art where the remaining toner is scraped by the cleaning blade, wasteful toner consumption can be suppressed. In addition, since the toner that is circulated in the state where the toner is adhered to the photoreceptor 2 is not likely to be recovered by the developing roller 7*a*, there is no problem in that the deteriorating toner increases in the developer.

In addition, in the embodiment, by applying the positive transferring bias Vt1 to the intermediate transfer belt 8*a*, the discharge is generated between the non-exposed portion of the photoreceptor 2 and the intermediate transfer belt 8*a* at the front side position TP0 of the transferring position TP, so that the charged polarity of the negatively charged particles adhered to the non-exposed portion is inverted. In other words, since the reversely charged particles are actively generated on the photoreceptor 2, the effect of the invention can be obtained even in case of using the toner or the developer where the reversely charged particles are not almost generated.

In addition, in the embodiment, as described above, the positively charged particles remain on the photoreceptor 2. On the other hand, the polarity of the negatively charged particles having the original charged polarity of the toner is inverted at the front side position TP0 of the transferring position TP, or the negatively charged particles are completely removed at the cleaning position BP, so that the negatively charged particles do not remain on the photoreceptor 2. Since the negatively charged particles adhered to the non-exposed portion of the photoreceptor 2 are transferred to the intermediate transfer belt 8*a*, the existence of the negatively charged toner on the non-exposed portion causes the occurrence of the ground fogging on the toner image. However, in the embodiment, since the negatively charged particles are changed to the positively charged particles by the polarity inversion or removed, only the positively charged particles can selectively remain on the photoreceptor 2, so that the occurrence of the ground fogging can be suppressed.

In addition, in the embodiment, excellent effects can be obtained even in the case where a micro-diameter toner having a volume average diameter of, for example, 5 μm or less is used. The reasons are as follows. Due to the diameter being small and the strong adhesive force to the photoreceptor, it is difficult to completely remove such a micro-diameter toner from the photoreceptor. Particularly, the external additive agents detached from the toner core particle may be infinitesimal particles, and it is very difficult to remove the infinitesimal particles.

In an apparatus in the related art where the remaining toner is removed from the photoreceptor by the cleaning blade or by the recovery in the developer, it is difficult to remove such a toner. Therefore, in the case where the micro-diameter toner is used, there may be a problem in the process. For example, in the case of using the cleaning blade, an abutting pressure of the blade is considered to be increased so as to more securely perform the cleaning. However, due to the increase in the pressure, filming occurs on the photoreceptor, or abrasion is facilitated early. In addition, in the configuration of the recovery in the developer, remaining materials that are not recovered may cause the image quality to deteriorate.

However, in the embodiment, a constant amount of the charged particles is allowed to remain on the photoreceptor 2 and the charged polarity is controlled, so that the apparatus can be operated without bad influence to the image quality or the life cycle thereof. In other words, in the embodiment, it is possible to very suitably use the micro-diameter toner.

In addition, in the image forming apparatus, a neutralization unit that neutralizes the surface of the photoreceptor is not provided after the transferring position TP. Although a neutralization unit may be provided so as to reset the voltage of the surface of the photoreceptor (so-called to erase an image history), in the embodiment, the above effect can be obtained by allowing the positively charged particles to remain on the surface of the photoreceptor 2. Therefore, the effect obtained from the neutralization of the remaining toner becomes lower. Accordingly, in terms of maximizing the aforementioned effect, it is preferable not to perform the neutralization. In addition, if the voltage of the surface of the photoreceptor is reset, a large change in the voltage is needed at the time of the next charging operation. At this time, discharge occurs between the charging unit 5 and the photoreceptor 2, so that the charged amount or the polarity of the positively charged particles on the photoreceptor 2 may be changed. In this point, it is also preferable not to perform the neutralization.

As described above, in the embodiment, the photoreceptor 2 functions as the "latent image carrier" of the invention, and the charging unit 5 and the exposing unit 6 function as the "charging unit" and the "latent image forming unit" of the invention, respectively. In addition, on the surface of the photoreceptor 2, the exposed portion that is exposed by the exposing unit 6 corresponds to the "image portion" of the invention, and the non-exposed portion corresponds to the "non-image portion". In addition, in the embodiment, the developer 7 functions as the "developing unit" of the invention, and the developing roller 7*a* functions as the "toner carrier" and the "toner carrying roller".

In addition, in the embodiment, the transferring unit 8 functions as the "transferring unit" of the invention, and the intermediate transfer belt 8*a* functions as the "transfer medium". In addition, the cleaning roller 4 functions as the "cleaning unit" of the invention, and the brush roller 4*a* functions as the "abutting member". In addition, the elastic member 762 provided to the regulating blade 76 functions as the "regulating member" of the invention.

In addition, the invention is not limited to the aforementioned embodiment, but various modifications can be made without departing from the spirit of the invention. For example, in the numerical example of the embodiment, the voltages Vmax, Vmin, and Vo are +200 V, −800 V, and −600 V, respectively. Therefore, there is a relationship of $V4=|Vmin-Vo|=200<V3=|Vmax-Vo|=800$. However, in terms of more securely flying the non-contact toner from the non-exposed portion of the photoreceptor 2, the voltages of the components may be set so that a relationship of the following equation can be satisfied.

$$V4=|Vmin-Vo|\geqq V3=|Vmax-Vo| \quad \text{(Equation 5)}$$

For example, in the case where the waveform duty WD is set to 70% and the voltage Vo is set to −350 V, the voltages Vmax and Vmin are +100 V and −900 V, respectively. Therefore, $V4=|Vmin-Vo|=550\geqq V3=|Vmax-Vo|=450$, so that the relationship of Equation 5 is satisfied. Accordingly, in the non-exposed portion of the photoreceptor 2, since the pull-back direction electric field strength is higher than the developing direction electric field strength, the adhesion of the negatively charged particles from the developing roller 7*a* to the non-exposed portion of the photoreceptor 2 is further facilitated.

In addition, for example, the aforementioned numerical values of the embodiment are exemplary ones, but the invention is not limited thereto. In addition, the cleaning bias applied to the cleaning roller 4 may be a superposition of an AC voltage on the DC voltage as well as the DC voltage in the aforementioned embodiment. In this case, the average voltage of the cleaning bias may have a polarity opposite to the regularly charged polarity of the toner.

In addition, the aforementioned embodiment is the so-called negative latent image type image forming apparatus where the toner is adhered to an area of the surface of the charged photoreceptor 2, from which charges are removed by exposure. On the photoreceptor 2, the exposed area (exposed portion) is the "image portion" of the invention where the toner is to be adhered, and the non-exposed area (non-exposed portion) is the "non-image portion" of the invention. However, the invention can be adapted to the so-called positive latent image type image forming apparatus where the toner is adhered to an area, in which charges are generated by the exposure. In this case, the exposed area on the photoreceptor becomes the "image portion", and the non-exposed area becomes the "non-image portion". In addition, although the negatively charged toner is used in the embodiment, the invention can be adapted to an image forming apparatus using the positively charged toner. In this case, the voltage relationship of components may be inverted.

In addition, the image forming apparatus according to the embodiment is an apparatus where the electrostatic latent image is formed by exposing the surface of the uniformly charged photoreceptor 2 by the exposing unit 6. However, besides the apparatus using the exposure, any latent image forming unit may be used if the latent image forming unit can form the electrostatic latent image on the surface of the charged latent image carrier.

In addition, in the structure of the surface of the developing roller 7*a* according to the embodiment, the convex portions 741 having a substantially rhombic shape and the concave portions 742 surrounding the convex portions 741 are regularly arrayed, but the shape of the convex portion or the structure of the surface of the developing roller is not limited thereto. Alternatively, for example, a structure where a plurality of dimples are formed on a substantially smooth enveloped cylindrical surface or a structure where spiral grooves are provided can be used.

In addition, besides the developing roller on which the concave-convex portions are regularly provided, for example, a developing roller having a surface roughened by a blast process, which is used in the related art, may be used if the developing roller can carry both of the contact toner and the non-contact toner without occurrence of toner flying from the developing roller.

In addition, although the number of the developing units 7 is not specifically described in the aforementioned embodiment, the invention can very suitably be adapted to a color image forming apparatus where a plurality of developing units are mounted on a rotatable rotary developing unit, a tandem image forming apparatus where a plurality of the developing units are disposed around an intermediate transfer medium, or a black-and-white image forming apparatus where a single developing unit is provided to form a black-and-white image.

The entire disclosure of Japanese Patent Application No. 2008-314167, filed Dec. 10, 2008 is expressly incorporated by reference herein.

What is claimed is:

1. An image forming apparatus comprising:

a latent image carrier that circulates in a predetermined rotating direction;

a charging unit that charges a surface of the latent image carrier with a voltage having the same polarity as a regular charging polarity of a toner non-contactively to the surface of the latent image carrier at a predetermined charging position;

a latent image forming unit that forms an electrostatic latent image on the surface of the latent image carrier by allowing the voltages of the charged surface of the latent image carrier to be different from each other between an image portion to which the toner is adhered and a non-image portion to which the toner is not adhered at a latent image forming position in a downstream of the charging position in the rotating direction;

a developing unit that has a toner carrier non-contactively facing the latent image carrier at a developing position in a downstream of the latent image forming position in the rotating direction and develops the electrostatic latent image as a toner image by transporting a charged toner carried on a surface of the toner carrier to the developing position and applying an alternating voltage as a developing bias;

a transferring unit that transfers the toner image on the transfer medium by abutting a transfer medium on the latent image carrier and applying a transferring bias having a polarity opposite to the regular charging polarity to the transfer medium at a transferring position in the downstream of the developing position in the rotating direction; and a cleaning unit that removes a toner that is charged with a regular charging polarity and remains to be adhered to the surface of the latent image carrier by abutting an abutting member applied with a voltage having a polarity opposite to the regular charging polarity on the latent image carrier at a cleaning position in a downstream of the transferring position in the rotating direction, wherein the toner carrier carries a toner layer including a contact toner that is directly in contact with the surface of the toner carrier and a non-contact toner that is not directly in contact with the surface of the toner carrier on the surface thereof, and wherein a voltage of the transferring bias is a DC voltage that does not generate discharge between the image portion of the latent image carrier and the transfer medium but generate discharge between the non-image portion of the latent image carrier and the transfer medium.

2. The image forming apparatus according to claim 1, wherein the toner carrier is a toner carrying roller that is formed in a roller shape having regular concave and convex portions on a surface thereof to be rotated, and the non-contact toner is carried in a concave portion of the surface of the toner carrying roller.

3. The image forming apparatus according to claim 1, wherein the toner carrier is a toner carrying roller that is formed in a roller shape having regular concave and convex portions on a surface thereof to be rotated, a top surface of each convex portion becomes a portion of the same cylindrical surface, and a difference in height of the convex portion from a concave portion is twice as large as a volume average diameter of the toner, and wherein the developing unit has a regulating member that is constructed with an elastic material to regulate toner adhesion to the convex portion by abutting an edge portion of the regulating member on the convex portion of the toner carrying roller at an upstream side of the developing position in the rotating direction of the toner carrying roller.

4. The image forming apparatus according to claim 1, wherein in a case where an electric field strength in the surface of the toner carrier required for the non-contact toner to fly from the surface of the toner carrier is a non-contact toner flying start electric field strength and an electric field strength in the surface of the toner carrier required for the contact toner to fly from the surface of the toner carrier is a contact toner flying start electric field strength, a maximum value of a strength of an electric field generated between the image portion of the latent image carrier and the toner carrier by the developing bias is larger than the contact toner flying start electric field strength, and a maximum value of a strength of an electric field generated between the non-image portion of the latent image carrier and the toner carrier by the developing bias is larger than the non-contact toner flying start electric field strength.

5. The image forming apparatus according to claim 1, wherein in a case where an electric field strength in the surface of the toner carrier required for the contact toner to fly from the surface of the toner carrier is a contact toner flying start electric field strength, a voltage of the image portion of the latent image carrier at the developing position is VL, a voltage of the non-image portion is Vo, a voltage of the developing bias at the time when a force generated to bias the toner charged with the regular charging polarity in a direction from the toner carrier to the latent image carrier is in maximum is Vmin, an adhesive force of the contact toner to the toner carrier is Fc, and an adhesive force of the non-contact toner to the toner carrier is Fn, a maximum value of a strength of an electric field generated between the image portion of the latent image carrier and the toner carrier by the developing bias is larger than the contact toner flying start electric field strength, and the following equation is satisfied $$|V\text{min}-VL|/|V\text{min}-Vo|<Fc/Fn.$$

6. The image forming apparatus according to claim 5, wherein the following equation is satisfied $$|V\text{min}-VL|/|V\text{min}-Vo|<7.$$

7. The image forming apparatus according to claim 1, wherein a voltage of the non-image portion of the latent image carrier at the developing position is Vo, a voltage of the developing bias at the time when a force generated to bias the toner charged with the regular charging polarity in a direction from the latent image carrier to the toner carrier is in maximum is Vmax, a voltage of the developing bias at the time when a force generated to bias the toner charged with the regular charging polarity in a direction from the toner carrier to the latent image carrier is in maximum is Vmin, the following equation is satisfied $$|V\text{min}-Vo|\geqq|V\text{max}-Vo|.$$

8. The image forming apparatus according to claim 1, wherein the abutting member of the cleaning unit is a brush roller having a plurality of brush hairs that have a conducting property and are applied with a voltage having a polarity opposite to the regular charging polarity of the toner to abut the surface of the latent image carrier.

9. The image forming apparatus according to claim 8, wherein the brush roller rotates along with the latent image carrier.

10. The image forming apparatus according to claim 1, wherein electrical neutralization of the latent image carrier between the transferring position and the charging position is not performed.

11. The image forming apparatus according to claim 1, wherein a volume average diameter of the toner is 5 μm or less.

12. An image forming method comprising:

disposing, around a latent image carrier that circulates in a predetermined rotating direction, a charging unit that charges a surface of the latent image carrier with a voltage having the same polarity as a regular charging polarity of a toner non-contactively to the surface of the latent image carrier, a latent image forming unit that forms an electrostatic latent image on the surface of the latent image carrier by allowing the voltages of the surface of the latent image carrier charged by the charging unit to be different from each other between an image portion to which the toner is adhered and a non-image portion to which the toner is not adhered, a developing unit that has a toner carrier non-contactively facing the latent image carrier and develops the electrostatic latent image as a toner image by carrying a charged toner on a surface of the toner carrier and applying an alternating voltage as a developing bias, a transferring unit that transfers the toner image on the transfer medium by abutting a transfer medium on the latent image carrier and applying a transferring bias having a polarity opposite to the regular charging polarity to the transfer medium, and a cleaning unit that removes a toner that is charged with a regular charging polarity and remains to be adhered to the surface of the latent image carrier by abutting an abutting member applied with a voltage having a polarity opposite to the regular charging polarity on the latent image carrier, along the rotating direction in this order, wherein the toner carrier is allowed to carry a toner layer including a contact toner that is directly contact with the surface of the toner carrier and a non-contact toner that is not directly in contact with the surface of the toner carrier on the surface thereof, and wherein a voltage of the transferring bias is a DC voltage that does not generate discharge between the image portion of the latent image carrier and the transfer medium but generate discharge between the non-image portion of the latent image carrier and the transfer medium.

* * * * *